US005583310A

United States Patent [19]

Sugiyama et al.

[11] Patent Number: 5,583,310

[45] Date of Patent: Dec. 10, 1996

[54] KEYBOARD MUSICAL INSTRUMENT SELECTIVELY INTRODUCING TIME DELAY INTO HAMMER DETECTING SIGNAL BETWEEN ACOUSTIC SOUND MODE AND ELECTRONIC SOUND MODE

[75] Inventors: Nobuo Sugiyama; Tomoyuki Ura, both of Shizuoka, Japan

[73] Assignee: Yamaha Corporation, Japan

[21] Appl. No.: 443,111

[22] Filed: May 17, 1995

[30] Foreign Application Priority Data

May 18, 1994 [JP] Japan ..... 6-128352

[51] Int. Cl.[6] ..... G10C 3/12; G10C 5/00; G10D 15/00; G10H 1/34

[52] U.S. Cl. ..... 84/719; 84/720; 84/2; 84/3; 84/171

[58] Field of Search ..... 84/719, 720, 744, 84/745, 2, 3, 170–172, 236–255, 423 R, 433, DIG. 7

[56] References Cited

U.S. PATENT DOCUMENTS

| | | | |
|---|---|---|---|
| 527,533 | 10/1894 | McChesney et al. . | |
| 533,661 | 2/1895 | McChesney et al. . | |
| 3,626,078 | 12/1971 | Sekiguchi | 84/1.24 |
| 4,067,253 | 1/1978 | Wheelwright et al. | 84/1.1 |
| 4,633,753 | 1/1987 | Takahashi | 84/220 |
| 4,704,931 | 11/1987 | Nagai et al. | 84/1.01 |
| 4,858,508 | 8/1989 | Shibukawa | 84/1.01 |
| 4,908,121 | 3/1990 | Usa et al. | 84/606 |
| 4,909,119 | 3/1990 | Morokuma | 84/702 |
| 5,117,728 | 6/1992 | Shibukawa et al. | 84/633 |
| 5,136,916 | 8/1992 | Shibukawa | 84/627 |
| 5,166,464 | 11/1992 | Sakata et al. | 84/662 |
| 5,241,130 | 8/1993 | Shibukawa | 84/659 |
| 5,374,775 | 12/1994 | Kawamura et al. | 84/615 |
| 5,386,083 | 1/1995 | Kawamura | 84/719 |
| 5,428,186 | 6/1995 | Kaneko et al. | 84/719 |
| 5,434,349 | 7/1995 | Kawamura | 84/719 |
| 5,444,181 | 8/1995 | Wada et al. | 84/719 |
| 5,463,184 | 10/1995 | Kawamura | 84/719 |

FOREIGN PATENT DOCUMENTS

| | | |
|---|---|---|
| 3707591C1 | 5/1988 | Germany . |
| TO910077 U | 10/1992 | Italy . |
| 61-245194 | 10/1986 | Japan . |
| 62-32308 | 8/1987 | Japan . |
| 4-19592 | 5/1992 | Japan . |
| 5-74834 | 10/1993 | Japan . |

*Primary Examiner*—Stanley J. Witkowski
*Attorney, Agent, or Firm*—Graham & James LLP

[57] ABSTRACT

A hammer sensor of a keyboard musical instrument monitors a hammer action from a home position to a rebounding point on a stopper or strings, and a controller determines a hammer velocity and a time at an intermediate point on a trajectory of the hammer in a recording mode; the controller delays the time so as to determine a key-on timing, and an electronic system reproduce the acoustic or electronic sound at the key-on timing in a playback mode so as to reproduce the acoustic or electronic sound at the same timing as the original sound.

5 Claims, 13 Drawing Sheets

KEYBOARD MUSICAL INSTRUMENT SELECTIVELY INTRODUCING TIME DELAY INTO HAMMER DETECTING SIGNAL BETWEEN ACOUSTIC SOUND MODE AND ELECTRONIC SOUND MODE

FIELD OF THE INVENTION

This invention relates to a keyboard musical instrument and, more particularly, to a keyboard musical instrument changeable between an acoustic sound mode and an electronic sound mode.

DESCRIPTION OF THE RELATED ART

The keyboard musical instrument is manufactured on the basis of an acoustic piano, and is equipped with a hammer shank stopper changeable between a free position and a blocking position. While the hammer shank stopper is resting in the free position, the hammers are driven for rotation in response to fingering of a player on the keyboard, and rebound on the strings for generating acoustic sounds. On the other hand, the hammer shank stopper in the blocking position does not allow the hammers to strike the strings, and an electronic sound system generates electronic sounds instead of the acoustic sounds. The electronic sounds are generated also on the basis of the fingering, and key sensors monitor the black and white keys for detecting depressed keys and the key motions.

The keyboard musical instrument changeable between the acoustic sound mode and the electronic sound mode is disclosed in Japanese Patent Application No. 4-174813. U.S. Ser. No. 08/073,092 was filed claiming the priority right on the basis of Japanese Patent Application No. 4-174813 together with other Japanese Patent Applications. Although several prior arts opposed against U.S. Ser. No. 4-174813, the U.S. patent application was patented, and U.S. Pat. No. 5,374,775 was issued on Dec. 20, 1994. The references cited in the patent prosecution are U.S. Pat. Nos. 2,250,065, 4,633,753, 4,704,931, 4,744,281, 4,970,929, 5,115,705 and 5,247,129 and Foreign Patent documents 44782 (Germany), 68406 (Germany), 97885 (Germany), 3707591 (Germany) and 3707591C1 (Germany), To9-1U000077 (Italy), 51-67732 (Japan), 55-55880 (Japan), 62-32308 (Japan), 63-97997 (Japan) and 614303 (Switzerland).

However, the key motion is not strictly corresponding to the hammer action, and the electronic sounds are not always faithful to player's intention given through the keyboard. For example, while the player is rapidly and shallowly repeating a key, the keyboard musical instrument repeatedly generates a soft tone. However, the electronic sound generating system repeatedly generates a loud tone, because the key is moved at high speed in the rapid shallow repetition.

If the key sensors are replaced with hammer sensors, the electronic sounds are more faithful to the fingering. In general, the intensity of the impact on the strings is in proportion to the final hammer velocity immediately before the impact, and the hammer sensors are positioned as close to the rebounding points of the hammers as possible. On the other hand, the rebounding point is varied depending upon the hammer shank stopper, and a change-over mechanism is required.

However, the change-over mechanism is complex, and occupies a large amount of space. For this reason, assembly workers encounter a problem in installation of the change-over mechanism into a narrow inner space of the acoustic piano.

SUMMARY OF THE INVENTION

It is therefore an important object of the present invention to provide a keyboard musical instrument which is simple without sacrifice of the faithfulness of electronic sounds.

To accomplish the object, the present invention proposes to delay impact timings by introducing delay time different between an acoustic sound mode and an electronic sound mode.

In accordance with the present invention, there is provided a keyboard musical instrument having at least an acoustic sound mode and an electronic sound mode, comprising: a) an acoustic piano including a-1) a plurality of keys selectively depressed by a player in the acoustic sound mode and the electronic sound mode, a-2) a plurality of hammer assemblies respectively associated with the plurality of keys, and rotatably supported, a-3) a plurality of key action mechanisms functionally connected to the plurality of keys, respectively, and selectively driving the plurality of hammer assemblies for rotation, and a-4) a plurality of string means respectively associated with the plurality of keys, and selectively struck by the plurality of hammer assemblies in the acoustic sound mode for producing acoustic sounds; b) a silent system changed between a free position in the acoustic mode and a blocking position in the electronic sound mode, the silent system in the free position allowing the plurality of hammer assemblies to selectively strike the plurality of string means, the silent system in the blocking position causing the hammer assemblies to rebound thereon before impacts on the plurality of string means; and c) an electronic system including c-1) a plurality of hammer sensors respectively monitoring the plurality of hammer assemblies, and respectively producing a plurality of hammer position signals indicative of trajectories of the associated hammer assemblies between respective home positions and respective rebounding points, impact timings being represented by intermediate points on the trajectories, respectively, the rebounding points being different between the acoustic sound mode and the electronic sound mode, c-2) a delay means delaying the impact timing so as to determine key-on timings, respectively, c-3) a first music data producing means for producing first music data respectively containing the key-on timings in the acoustic sound mode, c-3) a second music data producing means for producing second music data respectively containing the key-on timings in the electronic sound mode, and c-4) an electronic sound generating means responsive to the second music data for producing electronic sounds in the electronic sound mode.

The first music data may be supplied to another musical instrument or recorded in a memory system.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Structure of Keyboard Musical Instrument

Figure 1:
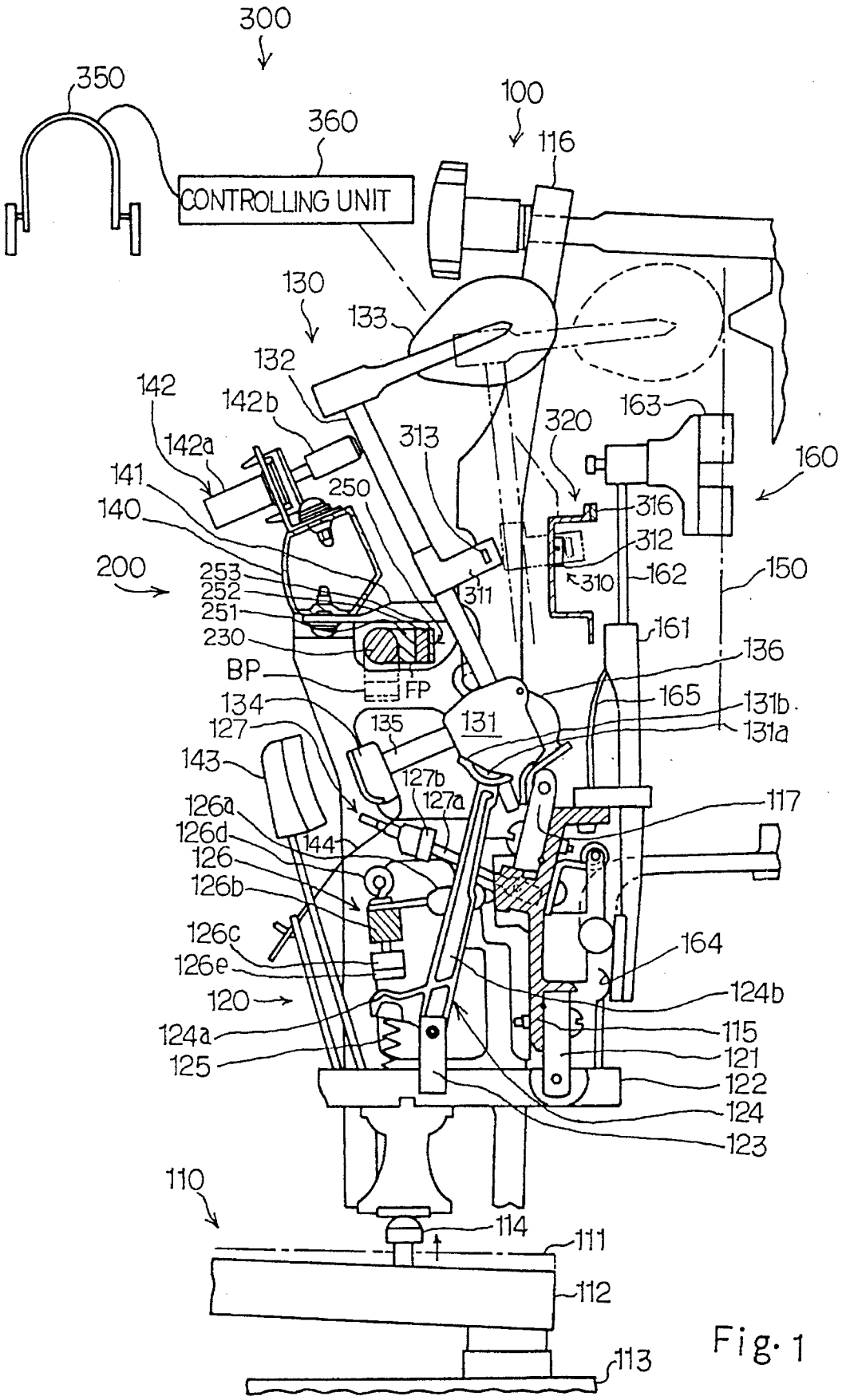
FIG. 1 is a side view showing the structure of a keyboard musical instrument according to the present invention.

Referring first to FIG. 1 of the drawings, a keyboard musical instrument embodying the present invention largely comprises an acoustic piano 100, a silent system 200 and an electronic system 300, and has at least a standard acoustic sound mode, a recording mode, a playback mode and an electronic sound mode. The electronic system 300 records a performance in any one of the standard recording mode and the electronic sound mode, and reproduces a music through the acoustic sounds in the playback mode. The keyboard musical instrument may directly supply music data information to another electronic musical instrument without storing in a memory, and have only the standard acoustic sound mode and the electronic sound mode. In the following description, word "front" means a closer position to a player siting on a stool, and words "clockwise" and "counter clockwise" are determined on a referenced figure.

The acoustic piano 100 comprises a keyboard 110, and a plurality of black and white keys 111 and 112 form the keyboard 110. Though not shown in FIG. 1, the black and white keys 111 and 112 are turnably supported by a balance rail, and the balance rail is mounted on a key bed 113. Capstan screws 114 project from the rear end positions of the black and white keys 111 and 112, respectively. While a player is exerting a force on the black and white keys 111 and 112, the black and white keys 111 and 112 are traveling from respective rest positions to respective end positions.

The acoustic piano 100 further comprises a plurality of key action mechanisms 120 functionally connected to the capstan buttons 114 of the black and white keys 111 and 112, respectively. The key action mechanisms 120 are similar in structure to one another.

Each of the key action mechanisms 120 comprises a whippen flange 121 fixed to a center rail 115, a whippen assembly 122 turnably supported by the whippen flange 121, a jack flange 123 fixed to an intermediate portion of the whippen assembly 122, a jack 124 turnably supported by the jack flange 123, a jack spring 125 connected between the whippen assembly 122 and a toe **124*a* of the jack 124, a regulating button mechanism 126 supported by the center rail 115 and opposed to the toe 124*a* and a jack stop mechanism 127 for restricting the motion of the jack 124. The center rail 115 is supported at both ends and intermediate portions thereof by action brackets 116, and the center rail 115 and the action brackets 116 form in combination a frame for the action mechanisms 120**.

The whippen assembly 122 is held in contact with the capstan button 114, and is rotated around the whippen flange 121 by the associated black or white key 111/112 during a key motion from the rest position to the end position.

When the key 111/112 is in the rest position, the whippen assembly 122 is substantially horizontal. The jack spring 125 urges the jack 124 in the clockwise direction, and the key 111/112 in the rest position makes the toe **124*a* spaced from the regulating button mechanism 126**.

The regulating button mechanism 126 comprises a fork screw **126*a* fixed to the center rail 115, a regulating rail 126*b* connected to the fork screw 126*a*, a regulating button 126*c* connected through a regulating screw 126*d* to the regulating rail 126*b* and a regulating button felt 126*e*, and the gap between the regulating button felt 126*e* and the toe 124*a* is changeable by rotating the regulating screw 126*d*. The regulating rail 126*b* laterally extends, and all of the regulating buttons 126*c* share the regulating rail 126*b***.

The jack stop mechanism 127 comprises a jack stop rail **127*a* fixed to the center rail 115, a jack stop rail screw 127*b* and a jack stop felt 127*c* connected through the jack stop rail screw 127*b* to the jack stop rail 127*a*. When the key 111/112 is in the rest position, the jack stop felt 127*c* is spaced from the long portion 124*b* of the jack 124. After an escape of the jack 124, the long portion 124*b* is rearwardly moved, and rebounds on the jack stop felt 127*c*. The gap between the jack stop felt 127*c* and the long portion 124*b* is regulable by rotating the jack stop rail screw 127*b***.

The acoustic piano 100 further comprises a plurality of hammer assemblies 130 respectively driven for rotation by the key action mechanisms 120, and the hammer assemblies 130 are similar in structure to one another. The center rail 115 and the action brackets 116 further serves as a frame for the hammer assemblies 130.

Each of the hammer assemblies 130 comprises a hammer butt 131 rotatably supported by a butt flange 117 bolted to the center rail 115, a hammer shank 132 projecting from the hammer butt 131, a hammer 133 fixed to the leading end of the hammer shank 132, a catcher 134 attached to the hammer butt 131 by means of a catcher shank 135 and a butt spring 136 urging the hammer butt 131 in the counter clockwise direction. A butt under felt **131*a* and a butt under cloth 131*b* are fixed to the lower surface of the hammer butt 131. While the key 111/112 is staying in the rest position the jack spring 125 and the butt spring 136 hold the leading end of the long portion 124*b* and the butt under cloth 131*b*** in contact with one another.

The acoustic piano 100 further comprises a hammer rail 140 provided for the hammer assemblies 130, a hammer rail hinges 141 connected between the action brackets 116 and the hammer rail 140, a plurality of shock absorbers 142 fixed to the hammer rail 140, a plurality of back checks 143 opposed to the catchers 134, a plurality of bridle tapes 144 and a plurality of sets of strings 150 stretched along a sound board (not shown).

The plurality of shock absorbers 142 are respectively associated with the hammer assemblies 130, and a holder 142*a*, a plunger 142*b* projectable from and retractable into the holder 142*a* and a damping member such as a rubber block (not shown) provided inside of the holder 142*a* form in combination each of the shock absorbers 142. The plurality of shock absorbers 142 define respective home positions of the hammer assemblies 130.

When the black and white keys 111/112 are in the rest position, the key action mechanisms 120 rearwardly urge the associated hammer assemblies 130, and the hammer shanks 132 are held in contact with the plungers 142*b*.

If the hammer assembly 130 is driven for rotation by the key action mechanism 120, the hammer assembly 130 rushes toward the set of strings 150, and rebounds on the strings 150 or the silent mechanism 300 (which will be hereinbelow described in detail). After the rebound, the hammer assembly 130 rearwardly moves, and is brought into collision with the plunger 142*b*. The plunger 142*b* is retracted into the holder 142*a*, and the damping block in the holder 142*a* takes up the kinetic energy of the hammer assembly 130. Thus, the shock absorbers 142 prevent the hammer assemblies 130 from rebound, and maintain the hammer assemblies 130 at the home positions.

While the hammer assemblies 130 are resting in the home positions, the catchers 134 are spaced from the back checks 143. When the hammer shanks 132 are brought into collision with the plungers 142*b*, the catchers 134 are also brought into collision with the back checks 143, and rebound on the back checks 143.

The bridle tapes 144 combine the returning motions of the hammer assemblies 130 with the returning motions of the whippen assemblies 122, and prevent the sets of strings 150 from double strike with the hammer assemblies 130.

The keyboard musical instrument further comprises a plurality of damper mechanisms 160 respectively associated with the plurality of sets of strings 150. The damper mechanisms 160 are respectively driven by the black and white keys 111 and 112 through the whippen assemblies 122, and allow the sets of strings 150 to vibrate upon impacts of the hammers 133.

The damper mechanisms 160 are similar in structure to one another, and each of the damper mechanisms 160 comprises a damper lever 161 rotatably supported by a damper lever flange (not shown), a damper wire 162 upwardly projecting from the damper lever 161, a damper head 163 fixed to the leading end of the damper wire 162, a damper spoon 164 implanted into the front end portion of the whippen assembly 122 and a damper spring 165 urging the damper lever 161 in the clockwise direction. The damper lever 161 urged by the damper spring 165 causes the damper head 163 and the lower end thereof to be held in contact with the set of strings 150 and the damper spoon 164.

While a depressed key 111/112 is rotating the whippen assembly 122 in the clockwise direction, the damper spoon 164 pushes the damper lever 161, and rotates the damper lever 161 in the counter clockwise direction. As a result, the damper head 163 is left the strings 150, and allows the strings 150 to vibrate. After the release of the key 111/112, the damper spoon 164 is left the damper lever 161, and the damper spring 165 urges the damper lever 161 in the clockwise direction. As a result, the damper head 163 is brought into contact with the strings 150 again.

As will be understood from the foregoing description, the acoustic piano 100 is analogous from a standard upright piano.

The silent system 200 is supported by the action brackets 116, and is changed between a free position FP and a blocking position BP. The silent system 200 enters into the free position FP in the standard acoustic sound mode, and is changed to the blocking position BP in the electronic sound mode. The silent system 200 is maintained at either free or blocking position depending upon the recording performance through the acoustic sounds or the electronic sounds in the recording mode. A reproduction of the performance is also realized through the acoustic sounds or the electronic sounds, and the position of the silent system 200 is also dependent on the sounds.

Figure 2:
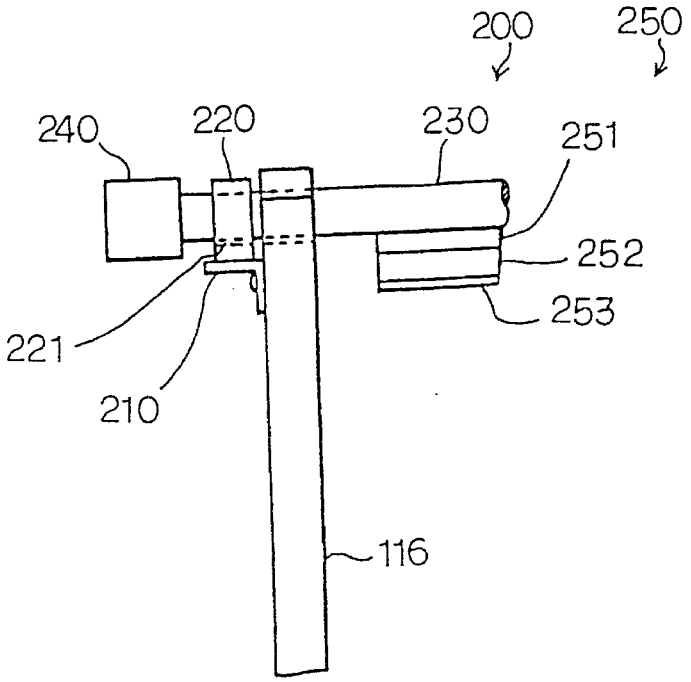
FIG. 2 is a front view showing a hammer shank stopper incorporated in the silent system.

The silent system 200 is constructed as follows. Angle members 210 are bolted to side surfaces of the action brackets 116 (see FIG. 2), and bearing units 220 are mounted on the angle members 210. A shaft member 230 is rotatably supported by felt members 221 of the bearing units 220, and a motor unit 240 is fixed to one end portion of the shaft member 230.

The shaft member 230 has a plurality of sections each located between the action brackets 116, and cushion units 250 are respectively attached to the sections of the shaft member 230, and the cushion units 250 are provided over the catchers 134.

The motor unit 240 is connected to the electronic system 300, and rotates the shaft member 230 in one of the clockwise direction and the counter clockwise direction. A player instructs the mode of operation to the electronic system 300, and the electronic system 300 energizes the motor unit 240 so as to change the silent system between the free position FP and the blocking position BP.

Each of the cushion units 250 comprises a cushion bracket 251 fixed to the section of the shaft member 250, a cushion sheet 252 attached to the cushion bracket 251 and a protective sheet 253 covering the cushion sheet 252. The cushion sheet 252 is, by way of example, formed of felt, and the protective sheet 253 may be formed of artificial leather.

While the silent system 200 is staying in the free position FP, the catchers 134 do not come into contact with the cushion units 250, and the hammers 133 rebound on the associated strings 150 as usual.

On the other hand, when the silent system 200 is changed from the free position FP to the blocking position BP, the protective sheets 253 are opposed to the catchers 134. In this situation, if the jack 124 escapes from the hammer butt 131, the catcher 134 is rotated together with the hammer butt 131 in the clockwise direction, and rebounds on the cushion unit 250 before the hammer 133 strikes the strings 150.

In this instance, the shaft member 230 is rotated by the motor unit 240: however, a link mechanism or a solenoid-operated actuator unit may rotate the shaft member 230. The link mechanism may be connected to a grip or a pedal projecting from a bottom sill.

The electronic system 300 comprises an array of hammer sensors 310 respectively associated with the hammer shanks 132, a channel-shaped bracket member 320 for supporting the hammer sensors 310, a headphone 350, and a controlling unit 360 connected to the hammer sensors 310 and the headphone 350. In the electronic sound mode, a player can listen to music through the headphone 350 instead of the acoustic sounds.

A shutter plate 311 and a photo-detector 312 form in combination each of the hammer sensors 310. The shutter plates 311 is generally L-shaped, and are respectively attached to the hammer shanks 132. The shutter plates 311 project toward the front side, and vertical slits 313 are respectively formed in the shutter plates 311.

Figure 3:
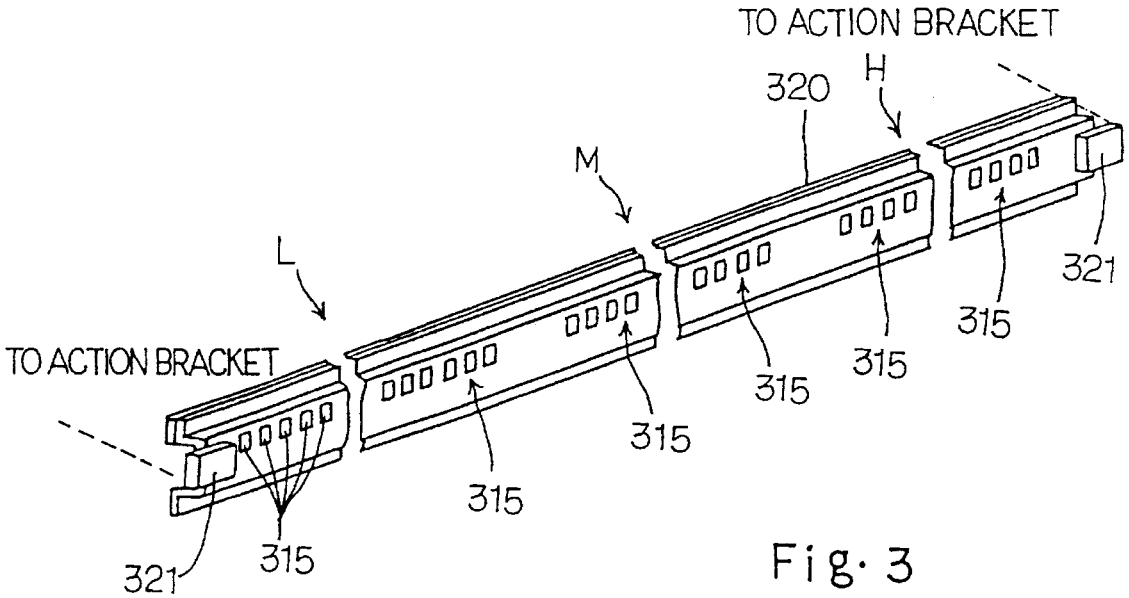
FIG. 3 is a perspective view showing an array of hammer sensors incorporated in the keyboard musical instrument.

The photo-detectors 312 are attached to the channel-shaped bracket member 314 at intervals, and a plurality of slits 315 are formed in the channel-shaped bracket member 314 as shown in FIG. 3. The channel-shaped bracket member 314 is split into three sections L, M and H, and the gaps among the three sections L, M and H allows the piano frame and the action brackets 116 to be thereamong. Brackets 321 are attached to the channel-shaped bracket member 320, and are fixed to the action brackets 116. Cushion members 316 are attached to the upper edge of the channel-shaped bracket member 314, and take up the impacts of the damper wires 162.

The plurality of slits 315 are respectively associated with the photo-detectors 312, and the shutter plates 311 are insertable into the slits 315, respectively.

Figure 4:
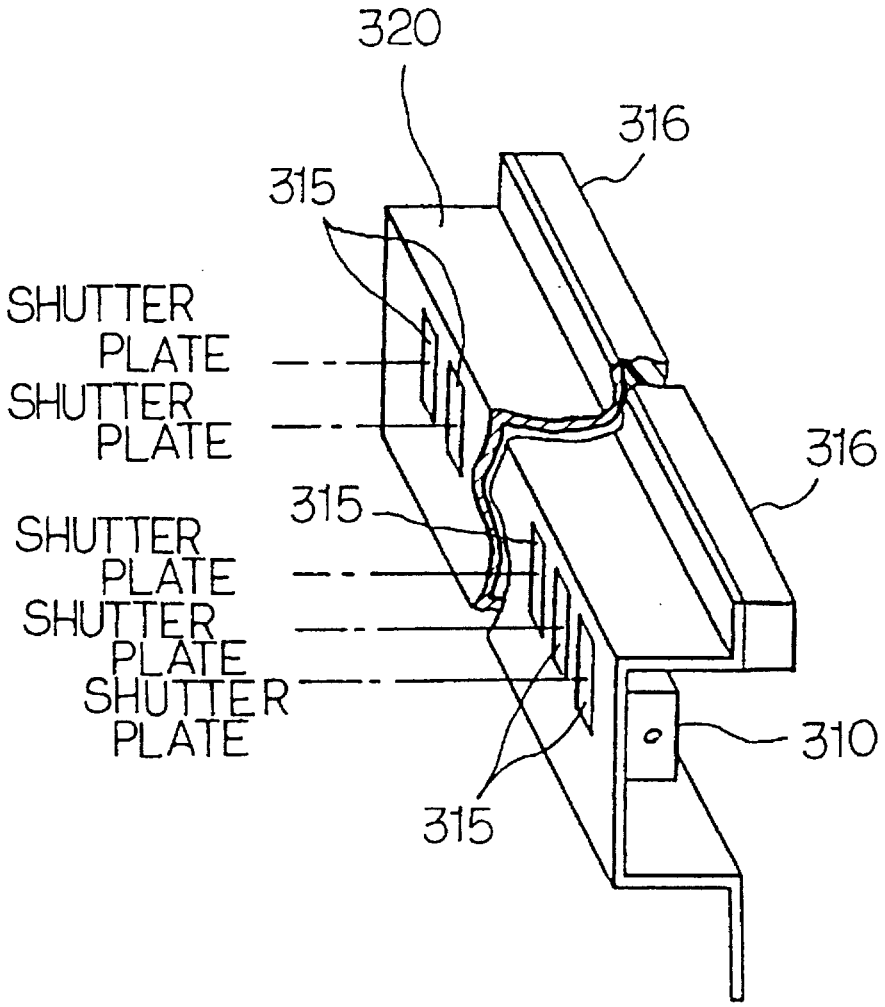
FIG. 4 is a perspective view showing the hammer sensors in a large scale.
Figure 5:
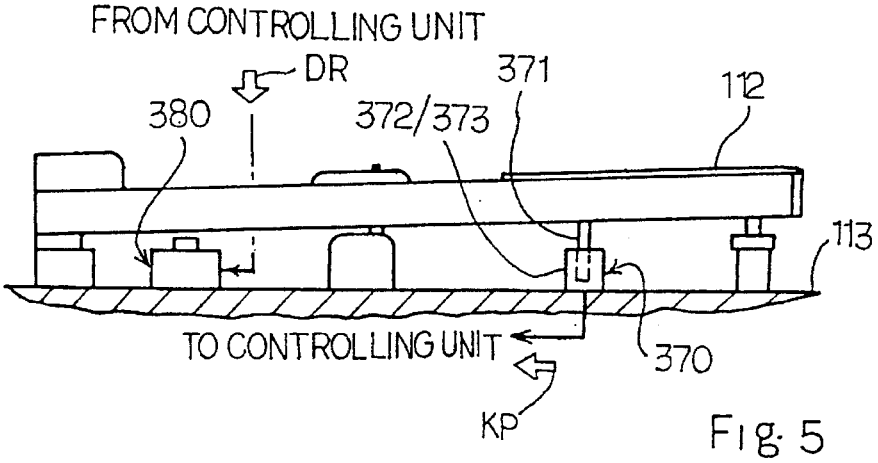
FIG. 5 is a side view showing a key sensor and a solenoid-operated actuator unit incorporated in an electronic sound system forming a part of the keyboard musical instrument.

Through not shown in the drawings, a photo-coupler installed in the controlling unit 360 and optical fibers connected to the photo-coupler form in combination each of the photo-detectors 312, and the optical fibers are opposed to each other across the associated slit 315. Therefore, the photo-detectors 312 radiate optical paths across the slits 315, and the shutter plates 311 intermittently interrupt the optical paths as shown in FIG. 4. Namely, while the hammer assembly 130 is reciprocally moving, the shutter plate 311 passes through the associated slit 315, and intermittently interrupts the optical path of the photo detector 312. The photo-detector 312 generates a detecting signal indicative of the interruptions, and supplies the detecting signal to the controlling unit 360.

While the keyboard musical instrument is staying in the recording mode, the hammer sensors 310 monitor the motions of the associated hammer assemblies 130, and report the current hammer positions varied with time to the controlling unit 360. The controlling unit 360 generates a series of music data codes. The music data codes are stored in an internal memory or an external memory such as, for example, a floppy disk, and the controlling unit 360 records the original performance in cooperation with the hammer sensors 310.

In the electronic sound generating mode, the hammer sensors 310 also detects the motions of the associated hammer assemblies 130, and report the current hammer positions varied with time as similar to the recording mode. The controlling unit 360 similarly generates a series of music data codes: however, the music data codes are sequentially supplied to a tone generator incorporated in the controlling unit 360. The tone generator forms an audio signal, and the audio signal generate electronic sounds instead of the strings 150.

The electronic system 300 further comprises a plurality of key sensors 370 respectively associated with the black and white keys 111 and 112 and a plurality of solenoid-operated actuator units 380 also respectively associated with the black and white keys 111 and 112.

Each of the key sensors 370 is implemented by a combination of a shutter plate 371 fixed to the associated key 111/112 and upper and lower photo-detectors 372/373. The upper and lower photo-detectors 372 and 373 are provided along a trajectory of the associated shutter plate 371, and the upper photo-detector 372 is spaced apart from the lower photo-detector 373 by a predetermined distance. While the associated key 111/112 is moving from the rest position to the end position, the shutter plate 371 firstly interrupts an optical path of the upper photo-detector 372 and, thereafter, an optical path of the lower photo-detector 373. On the other hand, the shutter plate 371 is firstly moved out of the optical path of the lower photo-detector 373 and, thereafter, the optical path of the upper photo-detector 372 on the way from the end position to the rest position. As will be described hereinlater, the controlling unit 360 determines a key-off of each key 111/112 on the basis of the variation of a key position signal KP supplied from each of the key sensors 370.

Figure 6:
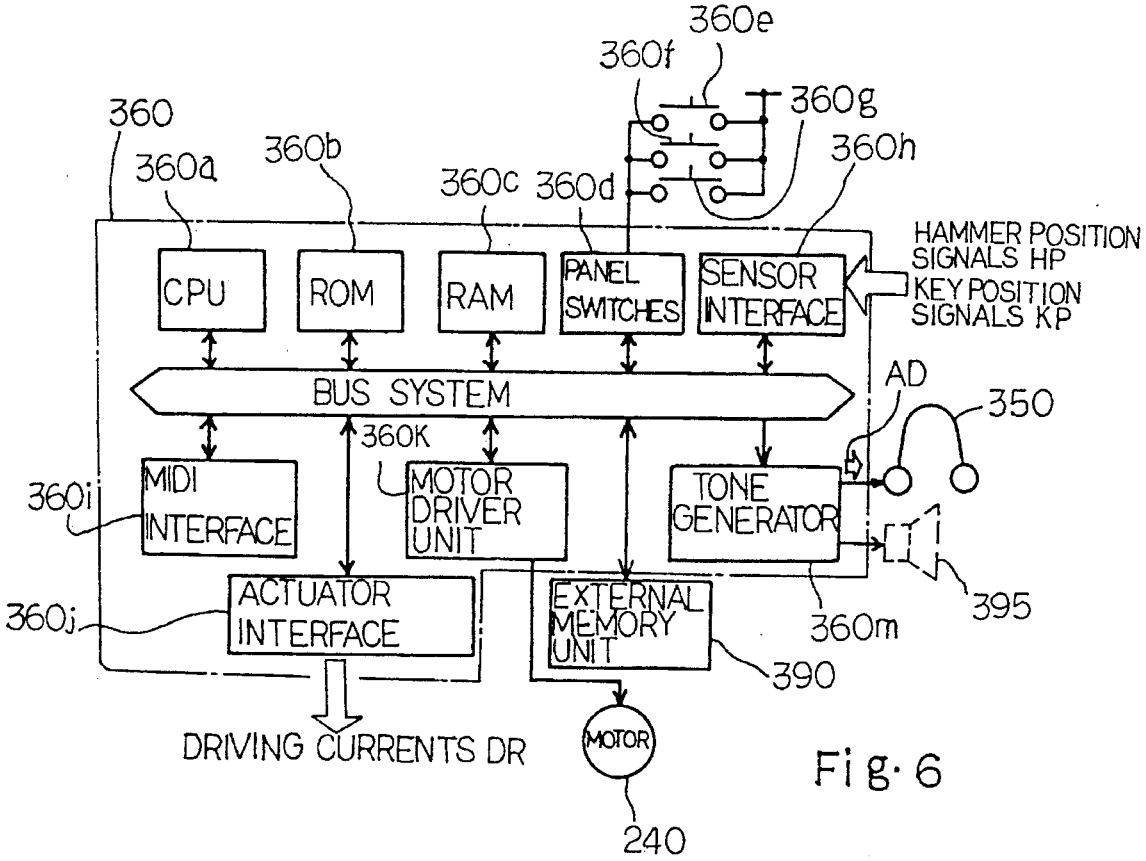
FIG. 6 is a block diagram showing the arrangement of the electronic sound system.

FIG. 6 illustrates the arrangement of the controlling unit 360, and determines an impact timing Ht and a hammer velocity Hv on the basis of a change between the photo-detecting state and the photo-interrupting state of the hammer sensors 310 in the recording mode through either acoustic or electronic sounds and the electronic sound mode. The controlling unit 360 also produces the music data codes for outputting them to an external musical instrument. The controlling unit 360 is further operative to determine the amount of driving current DR selectively supplied to the solenoid-operated actuator units 380 in the playback mode.

The controlling unit 360 comprises a central processing unit 360*a* for executing program sequences described hereinbelow, a read only memory unit 360*b* for storing the instruction codes of the program sequences, a random access memory unit 360*c* for storing data codes and panel switches 360*d* manipulative by a player, and a silent switch 360*e*, a recording switch 360*f* and a playback switch 360*g* are incorporated in the panel switches 360*d*.

When the player shifts the silent switch 360*e* to the electronic sound mode, the silent system 200 is changed from the free position FP to the blocking position BP. On the other hand, if the player shifts the silent switch 360*e* to the acoustic sound mode, the silent system 200 enters into the free position FP.

When the recording switch 360*f* is manipulated, the central processing unit 360*a* executes a recording program sequence for recording a performance. The playback switch 360*g* causes the central processing unit 360*a* to execute a playback program sequence for reproducing the original performance through the acoustic sounds.

One of the other switches 360*d* is assigned to an instruction for direct output to another musical instrument, and the music data codes are supplied to the musical instrument. The instructions given through the switches 360*d*, 360*e*, 360*f* and 360*g* are stored in internal registers of the central processing unit 360*a*. Another panel switch 360*d* is assigned to an instruction of tempo in the playback mode.

The controlling unit 360 further comprises a sensor interface 360*h* connected to the hammer sensors 310 and the key sensors 370. While the central processing unit 360*a* is executing the instruction codes of the recording program, the hammer sensors 310 and the key sensors 370 are sequentially scanned through the sensor interface 370*h* by the central processing unit 370*a*, and the central processing unit 370*a* produces a series of music data codes.

If the player depresses the white key 112 in a performance, the central processing unit 360*a* discriminates the depressed white key 112, and determines the key code assigned to the depressed white key 112. The central processing unit 360*a* calculates the hammer velocity Hv on the basis of a lapse of time between the photo-interruption and the photo-detection, and determines the impact timing Ht at the photo-detection through the slit 313. The key-on timing KON is delayed from the impact timing Ht as will be described hereinlater.

The central processing unit 360*a* further calculates a key velocity on the basis of the hammer velocity Hv. Then, the central processing unit 360*a* generates the music data code containing at least the key-code information, the piece of key-on information and a piece of key velocity information.

When the player releases the depressed white key 112, the white key 112 returns toward the rest position, and the lower photo-interrupter 373 and the upper photo-interrupter 372 are sequentially changed to the photo-detecting state. The central processing unit 360*a* determines a key-off timing at the change of the upper photo-interrupter from the photo-interrupted state to the photo-detecting state. Then, the central processing unit produces the music data code containing the key code information and a pieces of key-off information.

The controlling unit 360 further comprises a MIDI (Musical Instrument Digital Interface) interface 360*i*, and the MIDI interface 360*i* formats the key code information, the key-on information, the key velocity information, the key-off information into a MIDI code for communicating with another musical instrument. A series of MIDI codes may be supplied from another musical instrument to the MIDI interface 360*i*. The MIDI interface 360*i* extracts the key code information, the key-on information, the key velocity information and the key-off information from the MIDI code, and transfers these pieces of information to the central processing unit 360*a*. Thus, the MIDI interface 360*i* allows the keyboard musical instrument according to the present invention to perform an ensemble together with other musical instruments. An electronic accompaniment instrument can determine chords of a melody. If the MIDI codes are supplied to the electronic accompaniment instrument, a player can perform a music by generating a melody on the keyboard only.

If the player instructs the direct output, the music data codes are output through the MIDI interface 360*i* to another musical instrument.

The controlling unit 360 further comprises an actuator interface 360*j* connected to the solenoid-operated actuator units 380, and the actuator interface 360*j* selectively supplies the driving current DR to the solenoid-operated actuator units 380 under the control of the central processing unit 360*a*. The amount of driving current DR is in proportion to the key velocity, and the driving current is supplied to each key 111/112 at the key-on timing. On the other hand, the actuator interface 360*j* stops the driving current DR at the key-off timing, and the depressed key 111/112 returns toward the rest position.

The controlling unit 360 further comprises a motor driver unit 360*k* connected to the motor unit 240, and the motor driver unit 360*k* supplies the driving current to the motor unit 240.

An external memory unit 390 is provided for storing the music data codes, and is implemented by a floppy disk system in this instance. In the recording mode, the music data codes are supplied from the random access memory unit 360*c* to the external memory unit 390 for storing the music data codes on a floppy disk (not shown), and the external memory unit 390 transfers the stored music data codes to a specified memory area of the random access memory unit 360*c* through a direct memory access.

The controlling unit 360 further comprises a tone generator 360*m* for generating an audio signal AD tailored on the basis of the key code information, the key-on information, the key-off information and the key velocity information of the music data codes in the playback mode. Namely, the central processing unit 360*a* sequentially supplies the music data codes to the tone generator 360*m* in the playback mode, and causes the toner generator 851*m* to generate the audio signal AD. The tone generator 360*m* memorizes not only the waveform pattern of the acoustic piano sound but also other waveform patterns of different sounds, and the player can select one of the waveform patterns by manipulating one of the panel switches 360*d*.

In the playback mode, the tone generator 360*m* starts the read-out of the selected waveform pattern at the key-on timing, and continuously reads out the waveform pattern at a certain speed corresponding to the key code. For this reason, the audio signal AD is regulated in frequency to the supplied key code, and the envelope and the amplitude are controlled with the key velocity. When the tone generator 360*m* terminates or decays the audio signal AD for the supplied key code at the key-off timing, and the termination or the decay is depending upon the selected timbre.

The audio signal AD is supplied to the headphone 350. If the electronic system 300 is equipped with a speaker system 395, the audio signal AD is supplied to the speaker system in parallel to or instead of the headphone 350.

Behavior of the Keyboard Musical Instrument

Hammer Action

While a player is performing a music in the acoustic sound mode, the player selectively depresses the black and white keys 111 and 112 on the keyboard 110. The silent system 200 is in the free position FP, and allows the hammer assemblies 130 to strike the strings 150.

In the performance, the player is assumed to depress the white key 112, the capstan button 114 pushes up the whippen assembly 122, and is rotated in the clockwise direction. The jack 124 is moved together with the whippen assembly 122, and slowly rotates the hammer butt 131 around the butt flange 117. When the toe 124*a* is brought into contact with the regulating button felt 126*e*, the jack 124 is rotated around the whippen flange 123 in the counter clockwise direction against the elastic force of the jack spring 125, and the jack 124 escapes from the hammer butt 131. Then, the hammer assembly 130 is rotated around the butt flange 117 at high speed in the clockwise direction, and rebounds on the associated strings 150. The catcher 134 is brought into contact with the back check 143, and the backward motion of the white key 112 causes the jack 124 to return to the engagement with the hammer butt 131. Finally, the shock absorber 142 allows the hammer shank.132 to softly return to the home position.

The above described hammer action is monitored by the associated hammer sensor 312 as follows.

Figure 7:
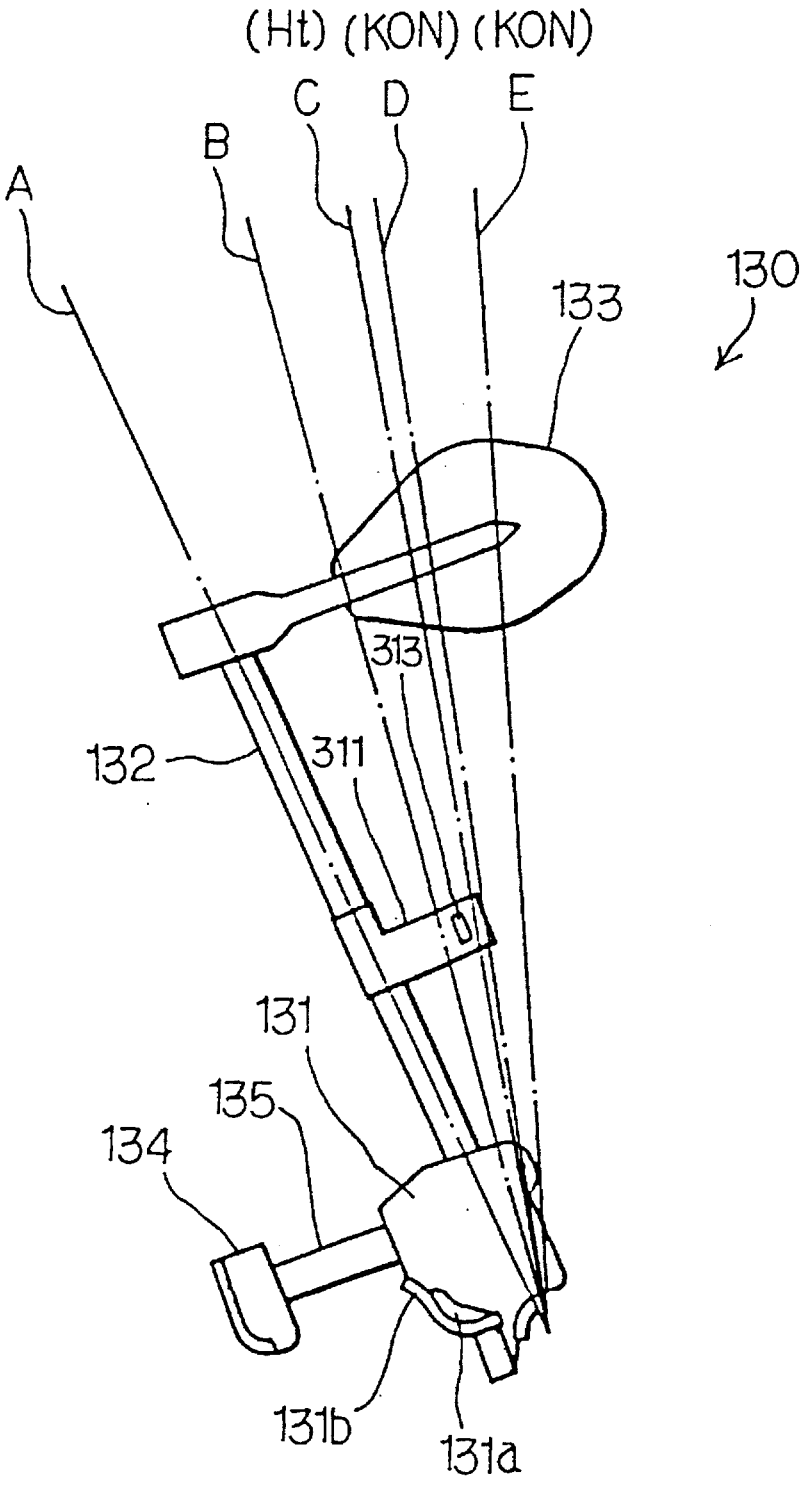
FIG. 7 is a side view showing the action of an hammer assembly incorporated in the keyboard musical instrument.

The home position of the hammer assembly 130 is represented by dot-and-dash line A in FIG. 7. When the jack 124 escapes from the hammer butt 131, the hammer assembly 130 is driven for rotation, and advances toward the strings 150 together with the shutter plate 311. The shutter plate 311 is inserted into the associated slit 315 of the channel-shaped bracket member 320, and the front edge of the shutter plate 311 interrupts the optical path of the associated photo-detector 312 at position B. Then, the hammer position signal HP indicative of the photo-interruption is supplied to the controlling unit 360.

The hammer assembly 130 further advances toward the strings 150, and the shutter plate 311 is deeply inserted into the slit 315. The slit 313 allows the photo radiation to pass between the optical fibers of the photo-detector 312, and the hammer position signal HP is changed to the photo-detecting state. Thereafter, the shutter plate 311 interrupts the optical radiation again at position C, and the hammer position signal HP is indicative of the photo-interruption again. The hammer heads 133 rebounds on the strings 150 at position E, and returns toward the home position. Position E is hereinbelow referred to as "impact position".

Thus, the hammer position signal HP is indicative of the photo-interruption twice. The controlling unit 360 decides the second photo-interruption at position C to be the impact timing Ht, and calculates the hammer velocity Hv on the basis of the lapse of time between position B and position C. The key-on timing KON is delayed from the impact timing Ht to position E, and the key-on timing KON and the key velocity are used for producing the music code as described hereinbefore. Although the controlling unit 360 decides the second photo-interruption to be the impact timing Ht, another controlling unit may interpret the photo-detection through the slit 313 as the impact timing. The music data codes are supplied through the MIDI interface 360*i* to an external electronic music instrument, and/or are memorized in the random access memory 360*c* if the player manipulated the recording switch 360*f*.

Assuming now that the player starts a performance in the electronic sound mode, the silent system 200 has been already changed to the blocking position BP, and the catcher 134 rebounds on the cushion unit 250 before the impact of the strings 150. The hammer assembly 130 returns to the home position as similar to that in the acoustic sound mode.

The catcher 134 at the rebounding point is corresponding to the hammer shank 132 at position D, and the shutter plate 311 interrupts the optical radiation twice at positions B and C. For this reason, the controlling unit 360 can produce the music data code as similar to the acoustic sound mode, and the tone generator 360*m* tailors the audio signal AD from the music data codes. The head phone 350 reproduces the performance.

In the acoustic sound mode, a sound generating timing for the electronic sound is delayed from the impact timing Ht, and is given at position D. Thus, the keyboard musical instrument implementing the first embodiment generates the electronic sounds in correspondence to the mechanical action of the hammer assemblies 130, and allows the player to enjoy the performance as if he is performing an acoustic piano.

The music data codes are also output from the MIDI interface 360*i* and/or recorded in the random access memory device 360*c* in the electronic sound mode.

Main Program Routine

Figure 8:
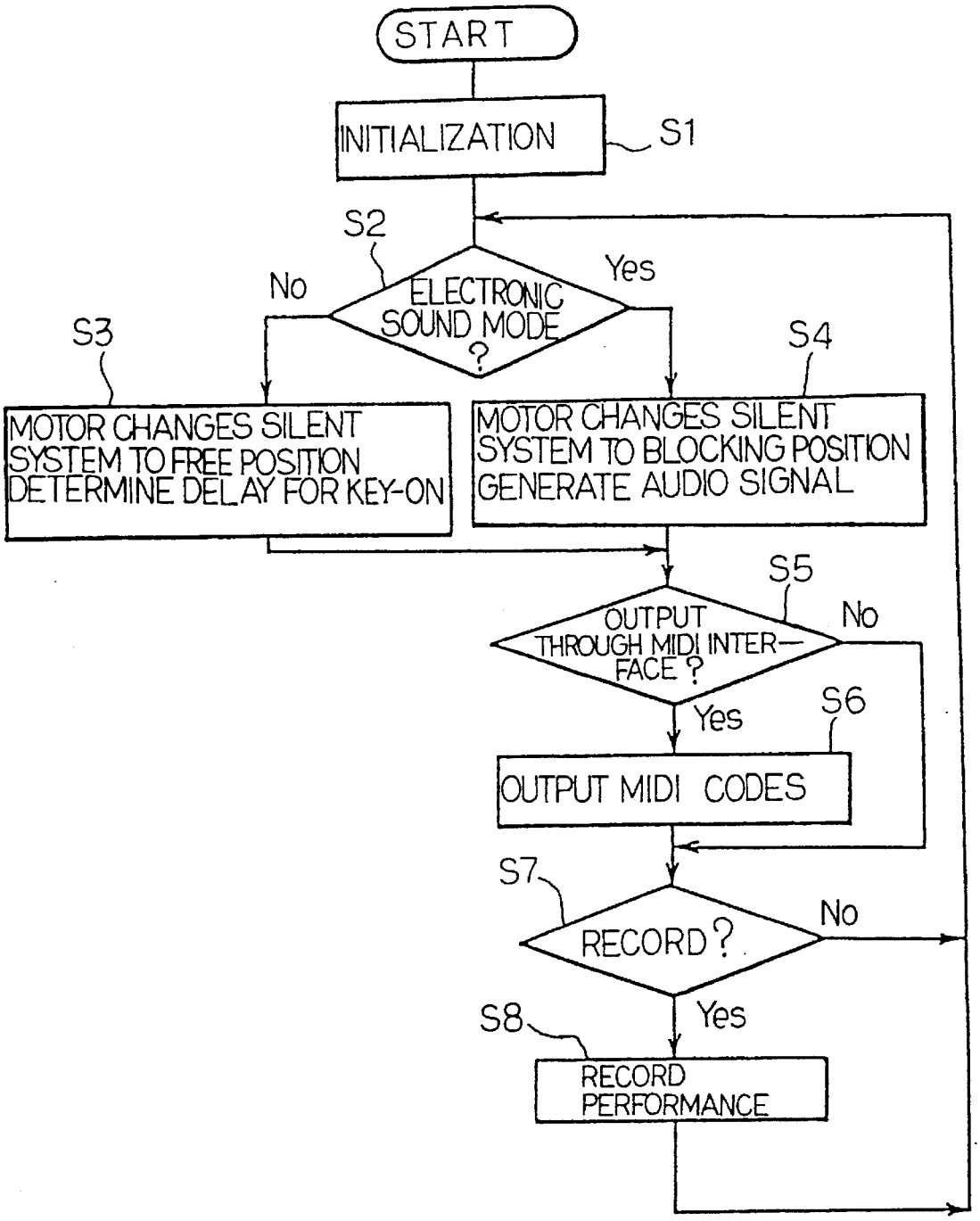
FIG. 8 is a flow chart showing a program sequence for an acoustic sound mode, an electronic sound mode and a recording mode.

FIG. 8 illustrates a program sequence executed by the central processing unit 360*a* in the acoustic sound mode, the electronic sound mode and the recording mode. When the electronic system 300 is powered on, the central processing unit 360*a* starts the program sequence, and firstly initializes the system as by step S1.

The central processing unit 360*a* proceeds to step S2 to see whether or not the player instructs the electronic sound mode. If the answer at step S2 is given negative, the central processing unit 360*a* proceeds to step S3, and instructs the motor driver unit 360*k* to supply the driving current to the motor unit 240 so as to change the silent system 200 to the free position FP. Of course, if the silent system 200 has been in the free position FP, the central processing unit 360*a* does not instruct the above job to the motor driver unit 360*k*.

In step S3, the central processing unit 360*a* determines the delay between the impact timing Ht and the key-on timing KON. Namely, the distance between the position C and the position E is divided by the hammer velocity Hv, and the key-on timing KON is delayed from the impact timing Ht by the product. For example, if the position E is spaced from the position C by 10 millimeters and the hammer velocity is 5 meters/second, the delay is 2 millisecond. Then, the key-on timing KON is delayed from the impact timing Ht by 2 millisecond. On the other hand, if the hammer velocity is 0.05 meter/second, the key-on timing KON is delayed from the impact timing Ht by 200 milliseconds. Thus, the central processing unit 360*a* adjusts the sound generating timing to the actual impact of the hammer 133 on the strings 150.

In order to determines the delay, the read only memory 360*b* has a table defining the relation between the hammer velocity Hv and the delay, and the central processing unit 360*a* determines the key-on timing KON by using the table. The central processing unit 360*a* may calculates the delay by using a certain equation. If the difference of the delay is ignoarable, the delay may be constant determined through an experiment.

On the other hand, if the answer at step S2 is given affirmative, the central processing unit 360*a* instructs the motor driver unit 360*k* to supply the driving current to the motor unit so as to change the silent system 200 to the blocking position BP as by step S4. Of course, if the silent system 200 has been in the blocking position BP, the central processing unit 360*a* does not instruct the above job to the motor driver unit 360*k*.

In step S4, the central processing unit 360*a* introduces delay between the impact timing Ht and the key-on timing KON, and the delay is different from the delay in the acoustic sound mode described hereinbefore. In detail, the hammer assemblies 130 rebound at the position D, and the central processing unit 360*a* retards the key-on timing KON to the position D. The position D is spaced from the position C by another predetermined distance, and the delay is calculated by dividing the distance by the hammer velocity Hv. For example, if the distance between the positions C and D is 2 millimeters and the hammer velocity is 5 meters/second, the key-on timing KON is delayed from the impact timing Ht by 0.4 millisecond. On the other hand, if the hammer velocity is 0.05 meter/second, the delay is 40 milliseconds. Thus, the key-on timings are regulated to the rebound on the cushion units 250, and the player feels the performance similar to that of an acoustic piano. A table of the read only memory 360*b* or an equation is available for the key-on timings as similar to the acoustic sound mode.

The central processing unit produces the music data codes, and supplies the music data codes to the tone generator 360*m*. The tone generator 360*m* tailors the audio signal AD, and the player hears the music through the headphone 350.

Thus, the central processing unit 360*a* is responsive to the manipulation of the silent switch 360*e* for changing the position of the silent system 200, and the keyboard musical instrument generates either acoustic or electronic sounds in response to the fingering on the keyboard 110.

After step 3 or step 4, the central processing unit 360*a* proceeds to step S5, and decides whether or not the player intends to output the music data codes through the MIDI interface 360*i*.

If the answer at step S5 is given affirmative, the central processing unit 360*a* transfers the key code information, the key-on information, the key-off information and the key velocity information to the MIDI interface 360*i*, and the MIDI interface 360*i* produces the MIDI codes from the given information. The MIDI codes are output from the MIDI interface 360*i* to the electronic musical instrument or the keyboard musical instrument of a similar type as by step S6.

The MIDI code contains the key code information, the key-on information and the key velocity information or the key code information and the key-of information. As described hereinbefore, the key-on timing KON is delayed, and, accordingly, the key code information and the key velocity information are also delayed in accordance with the key-on timing KON.

After step S6, the central processing unit 360*a* proceeds to step S7. If the answer to step S5 is given negative, the central processing unit 360*a* proceeds to step S7 without execution of step S6.

In step S7, the central processing unit 360*a* checks the recording switch 360*f* whether or not the player requests the recording. If the answer at step S7 is given negative, the central processing unit 360*a* returns to step S2. Thus, the central processing unit reiterates the loop consisting of steps S2, S3, S4 to S7 for generating the acoustic sounds in the acoustic sound mode and the loop consisting of steps S2, S3 to S7 in the electronic sound mode.

On the other hand, if the player manipulates the recording switch 360*f*, the answer at step S7 is given affirmative, and the central processing unit 360*a* proceeds to step S8.

In step S8, the delay is determined in step S3 or step S4, and the key-on timing KON is delayed from the impact timing Ht. The central processing unit 360*a* calculates the key velocity, and writes the key-on information and the key velocity information together with the key code information in a memory area of the random access memory 360*c*. If the key-on or the key-off has been recorded, the central processing unit 360*a* determines a lapse of time therefrom or a duration in the random access memory 360*c* together with the key-on information, the key code information and the key velocity information. When the key sensor 370 reports the key-off, the central processing unit 360*a* writes the key-off information together with the key code information in another memory area of the random access memory 360*c*.

In this way, the central processing unit 360*a* successively writes the set of the key code information, the key-on information, the key velocity information and the duration and the set of key code information, the key-off information and the duration into the random access memory 360*c*.

Figure 9:
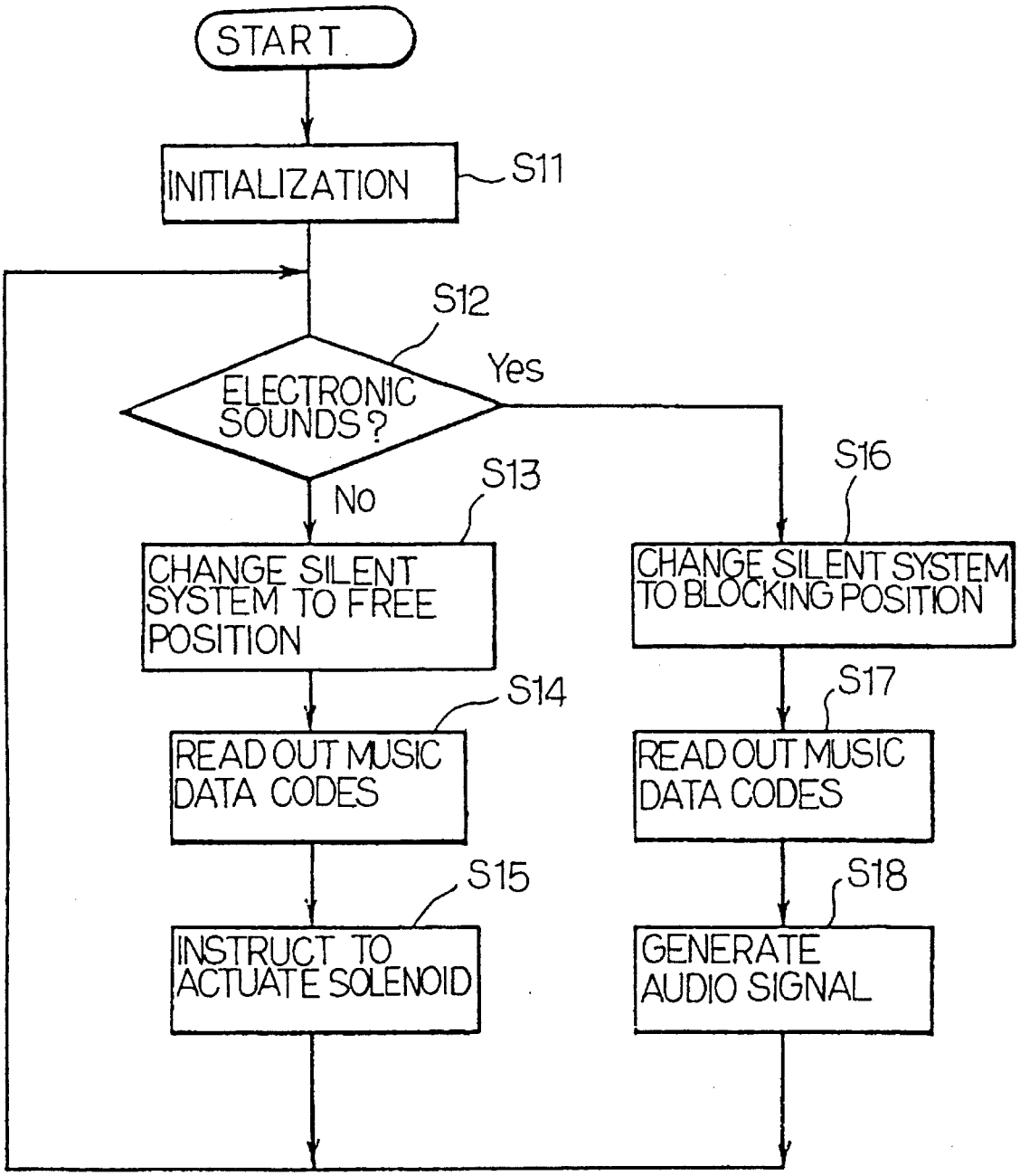
FIG. 9 is a flow chart showing a program sequence for a playback mode.

If the player manipulates the playback switch 360*g*, the central processing unit 360*a* executes a program sequence shown in FIG. 9, and firstly initializes the system as by step S11. In the initialization, the central processing unit 360*a* instructs the motor driver unit 360*k* to reset the motor unit 240 into the free position FP, if necessary, and determines a tempo for the music to be reproduced.

After the initialization, the central processing unit 360*a* proceeds to step S12, and checks the silent switch 360*e* whether or not the player wants the electronic sounds.

If the answer at step S12 is given negative, the central processing unit 360*a* instructs the motor driver unit 360*k* to change the silent system 200 to the free position FP. Of course, if the silent system 200 has already been in the free position, the central processing unit 360*a* maintains the silent system 200 in the free position FP.

The central processing unit 360*a* proceeds to step S14, and reads out the music data codes already transferred from the external memory system 390 to the random access memory device 360*c*. The read-out is carried out through an interruption, and the interruption is repeated in synchronism with the tempo clock. In this instance, the interruption is repeated twenty four times per each crotchet. The central processing unit 360*a* sequentially reads out the music data codes from the random access memory 360*c*. In detail, the central processing unit extracts the piece of information indicative of the duration from the music data code, and decrements the value of the duration in synchronism with the tempo clock. When the value of the duration reaches zero, the central processing unit 360*a* reads out the next music data code. The central processing unit 360*a* extracts the duration again, and repeats the above function. Thus, the music data code is read out at the timing after the estimated lapse of time from the impact timing Ht, and the music data codes are sequentially fetched by the central processing unit 360*a* in the same order as in the recording mode.

The central processing unit 360*a* determines the amount of driving current DR on the basis of the key velocity information, and informs the actuator interface 360*j* of the amount of driving current DR as well as the supply/stop timing as by step S15.

If the player instructs the electronic system 360 to reproduce the music through the acoustic sounds, the central processing unit 360*a* reiterates the loop consisting of step S12 to step S15, and the solenoid-operated actuator units 380 drives the black and white keys 111 and 112 instead of the player.

On the other hand, if the answer at step S12 is given affirmative, the central processing unit 360*a* proceeds to step S16, and instructs the motor driver unit 360*k* to change the silent system 200 to the blocking position BP.

Subsequently, the central processing unit 360*a* proceeds to step S17, and the read-out process is similar to that in step S14. However, the key code information, the key-on/key-off information and the key velocity information are transferred to the tone generator 360*m*, and the tone generator 360*m* tailors the audio signal AD as by step S18.

The timing at which the music data code is read out is matched with the rebounding timing of the catcher 135 on the cushion unit 250, and, for this reason, the player listens to the reproduced music through the head phone 350 or the speaker system 395 as similar to the original music. If the player selects a timbre different from the acoustic piano, the tone generator 360*m* reproduces the music with the selected timbre.

Thus, the central processing unit 360*a* reiterates the loop consisting of step S12, S16 to step S18, and the electronic system 300 reproduces the original performance through the electronic sounds.

As will be appreciated from the foregoing description, while the controlling unit 360 is working in the recording mode, the central processing unit 360*a* delays the impact timings Ht to the key-on timings KON, and produces the music data codes representing an original performance. As a result, the driving current DR or the audio signal AD are supplied to the solenoid-operated actuator units 380 or the headphone 350 at the timings respectively delayed from the impact timings Ht in the playback mode, and the reproduced performance is quite analogous from the original performance. This feature is achieved through the execution of the program sequences, and does not require a complex mechanical structure. The hammer velocity is directly calculated from the variation of the actual hammer position, and the intensity of the reproduced tone is approximately equal to the intensity of the original tone.

Modifications

Although the first modification delays the key-on timings, the first modification rewrites the impact timings Ht in the recording mode through the acoustic sounds in consideration of the delay. Moreover, while the controlling system 360 is recording an original performance through the electronic sounds, the central processing unit 360*a* may write the key-on and the key velocity at the impact timing Ht and determine the duration in consideration of the delay.

If the position C is close to the position D, the delay time may be ignored.

In the recording through the electronic sounds, the key-on timing KON may be delayed at the position E. In this modification, the amount of delay is equal to that of the recording through the acoustic sounds, and the program sequence is simplified.

The cushion units 250 and the key sensors 310 may not be strictly positioned in the keyboard musical instrument. If so, the distance between the position C and the position D are irregular, and the delay is not constant. In this instance, the program sequence shown in FIG. 8 has a correction step where the delay is changed depending upon the actual distance between the position C and the position D.

An appropriate regulating mechanism may be incorporated in the keyboard musical instrument for regulating a distance between the strings and the hammer head at the escape point. One of the available regulating mechanisms rotates the regulating bracket 126*a* so as to change the gap between the regulating button 126*e* and the toe 124*a*. Another available regulating mechanism inserts a spacer between the regulating rail 126*b* and the regulating button 126*e*, and also changes the gap. The rotation and the insertion may be carried out by using a motor or a mechanical link mechanism.

Second Embodiment

Structure

Figure 10:
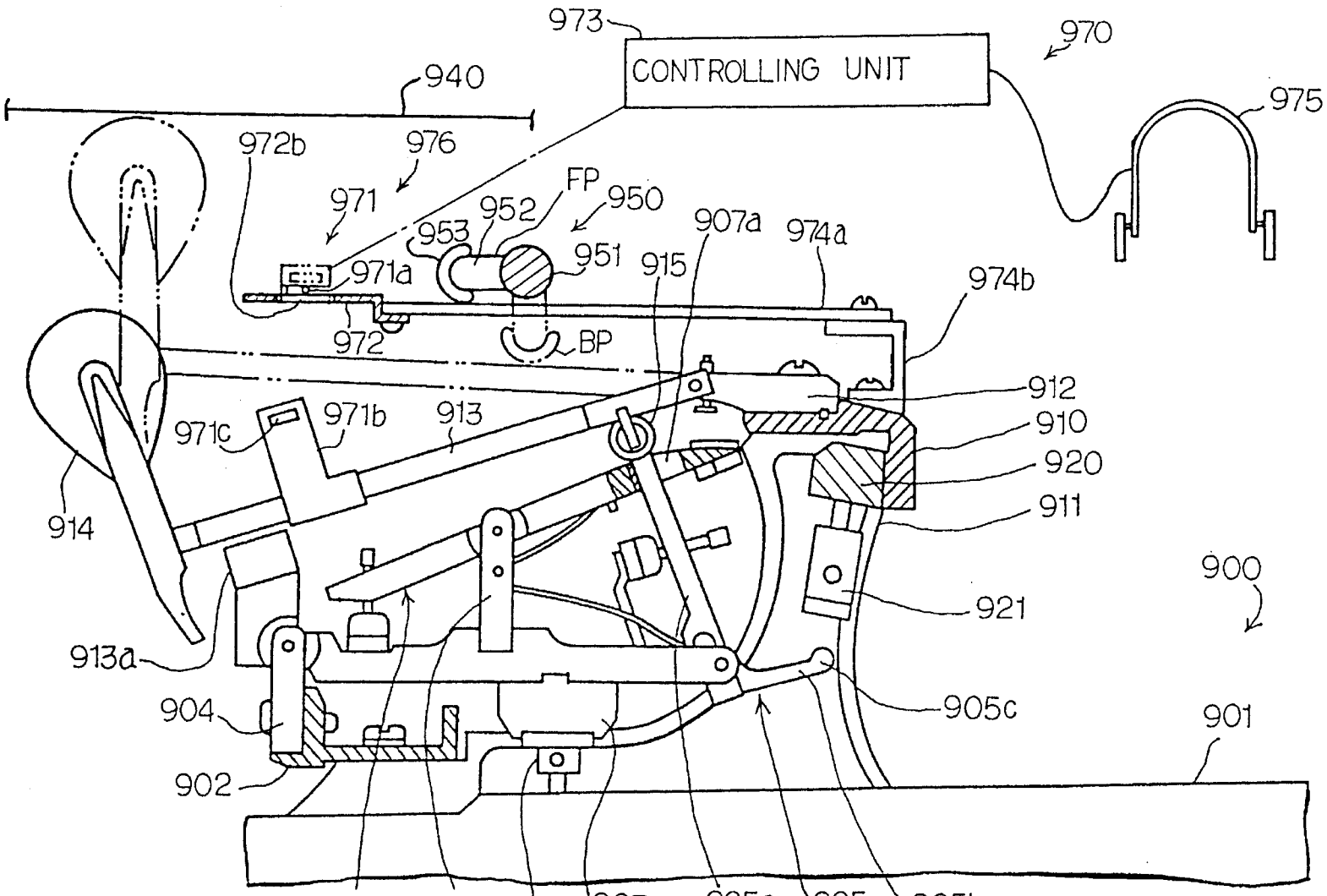
FIG. 10 is a side view showing essential parts of another keyboard musical instrument according to the present invention.

Turning to FIG. 10 of the drawings, a keyboard musical instrument embodying the present invention comprises a grand piano 900, a silent system 950 and an electronic system 970. The grand piano 900 is of a standard type.

The grand piano 900 comprises a plurality of black and white keys 901 turnable with respect to a frame (not shown). However, only one of the keys 901 and associated mechanisms are described hereinbelow.

Reference numeral 902 designates a whippen support rail, and a whippen assembly 903 is rotatably supported by a whippen flange 904 fixed to the whippen support rail 902. A jack 905 is turnably supported by the whippen assembly 903 at the opposite end to the whippen flange 904, and has a long portion 905*a* and a short portion 905*b* merged with the long portion 905*a* at the right angle.

A flange 906 is upright at the middle portion of the whippen assembly 903, and a repetition lever 907 is turnably supported by the flange 906. A through hole 907*a* is formed at one end portion of the repetition lever 907, and the long portion 906*a* of the jack 905 passes through the through hole 907*a*.

A capstan button 901*a* is implanted into the key 901, and is held in contact with the whippen assembly 903.

A shank rail 910 is supported by action bracket 911, and a shank flange 912 is fixed to the shank rail 910. A hammer shank 913 is swingably supported by the shank flange 912, and a hammer head 914 is fixed to the leading end of the hammer shank 913. A hammer roller 915 is rotatably connected to the lower surface of the hammer shank 913, and is slightly spaced over the top surface of the long portion 905*a* of the jack 905 at the home position. A hammer shank stop felt 913*a* is fixedly supported by the shank flange 904, and receives the hammer shank 913 falling after a rebound on the strings 940.

A regulating rail 920 is fixed to the hammer shank rail 910, and a regulating button 921 downwardly projects from the lower surface of the regulating rail 920. The regulating button 921 is opposed to the toe 905*c* of the jack 905, and the gap between the toe 905*c* and the regulating button 921 is adjustable by turning the regulating button 921.

The silent system 950 comprises a rotatable shaft member 951, stopper members 952 fixed to the rotatable shaft member 951 and cushion members 953 of artificial leather attached to the stopper members 952. Though not shown in FIG. 10, a motor unit is connected to the rotatable shaft member 951, and the rotatable shaft member 951 changes the stopper members 952 and the cushion members 953 between the free position FP and the blocking position BP.

While the silent system 950 is in the free position FP, the hammer head 914 strikes a set of strings 940 without an interruption of the cushion member 953, and the strings 940 vibrate so as to produce an acoustic sound. On the other hand, if the silent system 950 is changed to the blocking position BP, the hammer shank 913 rebounds on the cushion member 953 before the strike of the hammer head 914.

The electronic system 970 comprises a photo-detector 971 supported by a bracket 972, a key sensor (not shown), a solenoid-operated actuator unit (not shown), a controlling unit 973 connected to the photo-detector 971, the key sensor and the solenoid-operated actuator unit and a headphone 975. The bracket 972 is supported by a plate member 974*a*, and a bracket member 974*b* fixes the plate member 974*a* to the shank rail 910.

A photo-emitting element (not shown), a photodetecting element (not shown) and optical fibers 971*a* form the photo-detector 971 as similar to the first embodiment, and the photo-detector 971 and a shutter plate 971*b* form a hammer sensor 976. The shutter plate 971*b* is formed with a slit 971*c*. A slit 972*b* is formed in the bracket member 972, and allows the shutter plate 971*b* to pass therethrough for interrupting an optical beam between the optical fibers 971*a*.

The controlling unit 973 is similar to that of the first embodiment, and detailed description is omitted for avoiding a repetition.

The key sensor and the solenoid-operated actuator are similar to those of the first embodiment, and no further description is incorporated hereinbelow.

Modes of Operation

While the keyboard musical instrument is working in the acoustic sound mode, the shank stopper 950 is maintained in the free position FP, and a player is assumed to depress the key 901. The key 901 is moved from the rest position toward the end position, and the capstan button 901*a* pushes up the whippen assembly 903. The capstan button 903 and the jack 905 are rotated in the counter clockwise direction around the whippen flange 904, and the hammer shank 913 and the hammer head 974 are slowly rotated around the hammer shank flange 912 in the clockwise direction.

When the toe 905*c* is brought into contact with the regulating button 921, the jack 905 is rotated around the whippen assembly 903, and escapes from the hammer roller 915. Then, the hammer shank 913 and the hammer head 914 are rotated around the hammer shank flange 912 in the clockwise direction at high speed, and the hammer head 914 rebounds on the strings 940 without an interruption of the cushion member 953. The strings 940 vibrates, and generates an acoustic sound.

The hammer head 914 and the hammer shank 913 fall downwardly, and stops on the hammer shank stop felt 913*a*. The hammer roller 915 is maintained in the hole 907*a*.

When the player releases the key 901, the key 901 and the capstan button 901*a* are moved downwardly, and the toe 905*c* leaves the regulating button 921. The whippen assembly 903 is rotated in the clockwise direction, and the hammer shank 913 is rotated in the counter clockwise direction. Then, the jack 905 returns to the initial position beneath the hammer roller 915.

The hammer action is monitored by the hammer sensor 971, and the controlling unit determines an impact timing and a hammer velocity as follows.

When the hammer shank 913 and the hammer head 914 starts the rotation, the shutter plate 971*b* is also rotated in the clockwise direction, and the shutter plate 971*b* is inserted into the slit 972*b*. The optical beam is interrupted by the leading end portion of the shutter plate 971*b*, and the slit 971*c* allows the optical beam to pass between the optical fibers 971*a*. The shutter plate 971*b* further proceeds, and the optical beam is interrupted by the shutter plate 971*b* again.

Thus, the optical beam is interrupted by the shutter plate 971*b* twice before the rebound on the strings 940. In this instance, the second interruption is the impact timing, and the hammer velocity Hv is calculated by diving the distance between the first interruption and the second interruption by the lapse of time therebetween.

The program sequences shown in FIGS. 8 and 9 are suitable for the keyboard musical instrument implementing the second embodiment, and a key-on timing is delayed from the impact timing Ht by the lapse of time between the second interruption and a rebounding point on one of the strings 940 and the cushion member 953.

A music data code is produced from these information, and is transferred to the random access memory or the MIDI interface.

The controlling unit 973 determines a key-off timing on the basis of the key position signal of the key sensor as similar to the first embodiment, and is memorized in a music data code together with the key code information.

These music data codes are representative of the original performance, and are available for a reproduction of the music in the playback mode.

If the player wants to play a music through the electronic sounds, the silent system 950 is changed to the blocking position BP. When the player depresses the key 901, the key action mechanism and the hammer assembly behave as similar to those in the acoustic sound mode except for the interruption of the silent system 950. Namely, after the escape of the jack 905, the hammer shank 913 rebounds on the cushion member 953, and the hammer head 914 does not strike the strings 940. The returning motion after the rebound on the cushion member 953 is similar to that of the acoustic sound mode.

Although the hammer shank 913 rebounds on the cushion member 953, the shutter plate 971*b* interrupts the optical beam twice, and the impact timing Ht and the hammer velocity Hv are obtained as similar to those in the acoustic sound mode. The key-on timing KON is delayed from the impact timing Ht by the lapse of time between the second interruption and the rebound on the cushion member 953.

The controlling unit 973 produces the music data code through the execution of the program sequence shown in FIG. 8, and the tone generator produces the audio signal from the music data code. If the player designates the timbre of grand piano, the player hears the performance through the headphone 975.

The key-on timings are delayed to the actual rebounding points on the strings 940 or the cushion member 953, and the performance is exactly reproduced in the playback mode.

The impact timing may be the photo-detection through the slit 971*c*, and the delay may not be introduced between the impact timing and the key-on timing. The key-on timing in the electronic sound mode may be also the rebounding point on the strings 940.

As described hereinbefore, the keyboard musical instrument according to the present invention introduces appropriate delay between the impact timing and the key-on timing without a complex mechanical change-over system, and the acoustic sounds or the electronic sounds are reproduced in the playback mode at the same timings as those in the original performance.

Although particular embodiments of the present invention have been shown and described, it will be obvious to those skilled in the art that various changes and modifications may be made without departing from the spirit and scope of the present invention.

For example, an original performance may be reproduced through the acoustic sounds or the electronic sounds depending upon player's selection.

The key-off may be determined by the controlling unit on the basis of the hammer position signal.

Any kind of acoustic musical instrument is available for the keyboard the keyboard musical instrument according to the present invention. A cembalo, a celesta and an organ are typical examples of the available acoustic keyboard musical instrument.

The key sensor is available for detecting at least one of the impact timing and the hammer velocity. For example, the key velocity may be calculated by diving the distance between the upper photo-detector and the lower photo-detector by the lapse of time therebetween, and the impact timing may be at the photo-interruption of the lower photo-detector.

The hammer velocity may be corrected in the electronic sound mode. In this instance, the controlling unit estimates a final hammer velocity immediately before the impact on the strings, and an equation or a table defines the relation between the detected hammer velocity and the final hammer velocity. If a difference between different hammer velocities is ignoreable, a constant velocity is available.

A non-contact sensor is desirable for the hammer sensors and the key sensors: however, any contact type position sensor is available in so far as the sensor does not affect the key/hammer action.

Figure 11:
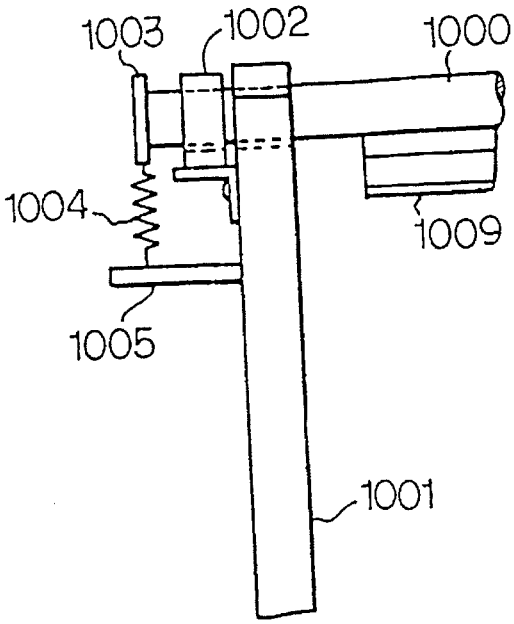
FIG. 11 is a rear view showing a silent system.
Figure 12:
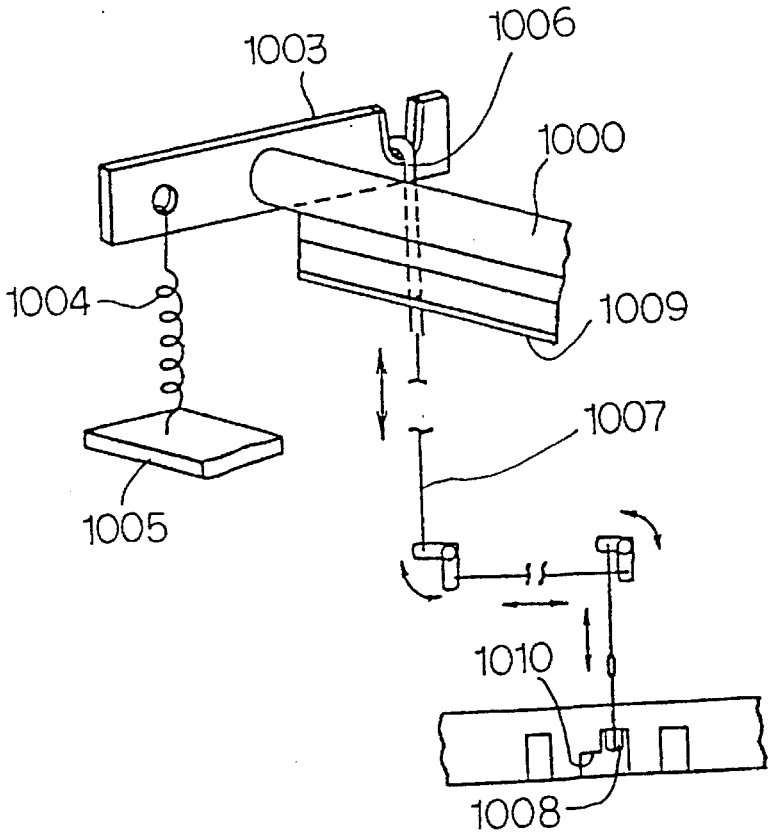
FIG. 12 is a perspective view showing the arrangement of a link mechanism of the silent system.

A link mechanism may be available for changing the silent system between the free position FP and the blocking position BP instead of the motor unit. FIGS. 11 and 12 illustrate the link mechanism. A rotatable shaft 1000 is supported by the action brackets 1001 by means of bearing units 1002, and a plate member 1003 is attached to the rotatable shaft 1000. One end of the plate member 1003 is connected through a spring member 1004 to a stationary member 1005, and a flexible wire 1006 is engaged with the other end of the plate member 1003. A link mechanism 1007 is connected between the flexible wire 1006 and a pedal 1008, and a player steps on the pedal 1008 for changing a hammer shank stopper 1009 from the free position to the blocking position. The player laterally moves the pedal 1008, and the pedal 1008 is engaged with a step portion 1010 for maintaining the blocking position. If the pedal 1008 is released from the step portion 1010, the spring 1004 changes the hammer shank stopper 1009 to the free position.

Figure 13:
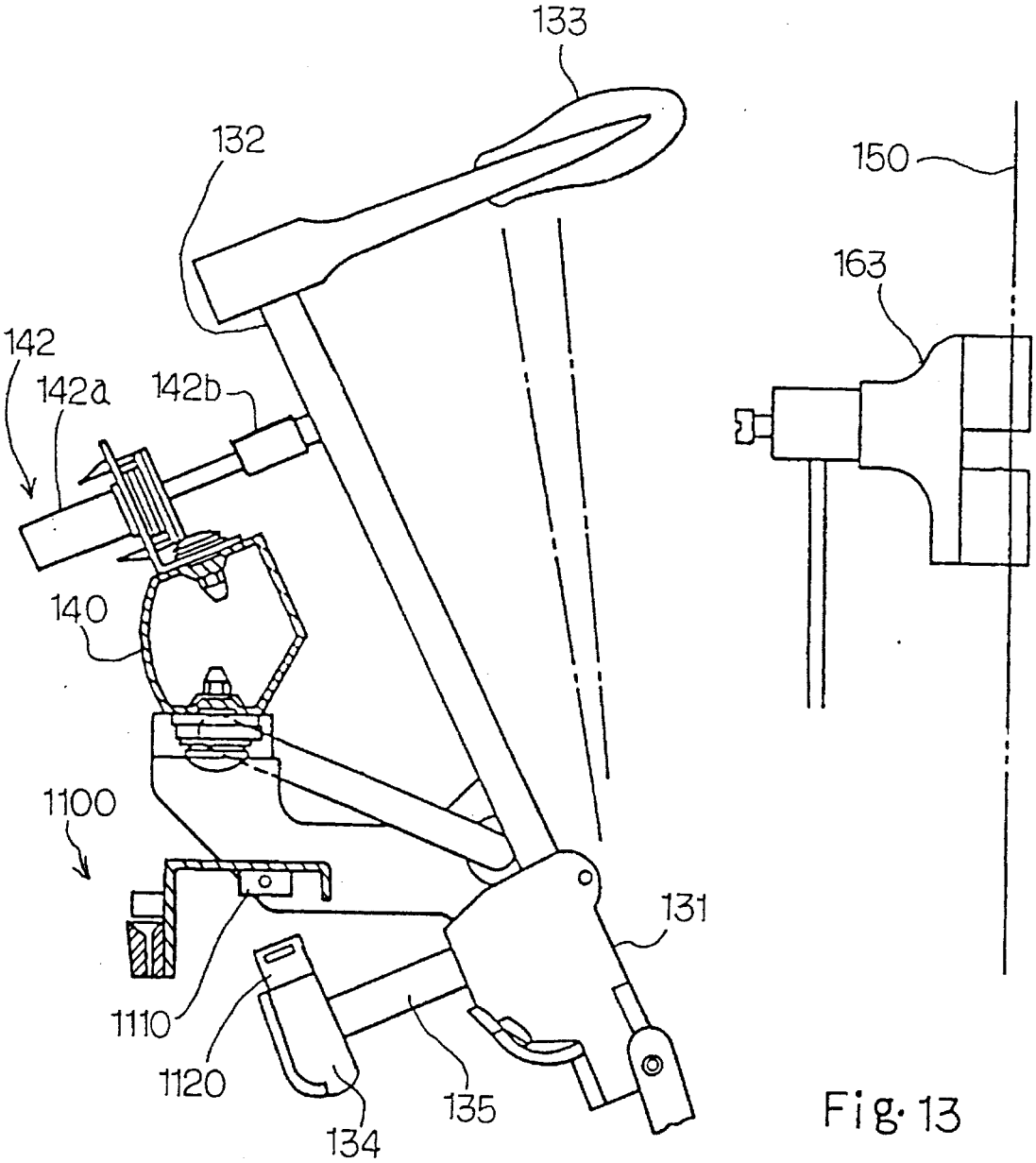
FIG. 13 is a side view showing another hammer sensor.

The hammer sensor may monitor the catcher 134. FIG. 13 illustrates the hammer sensor 1100 monitoring the catcher 134, and the parts of the upright piano are labeled with the same references as those of the first embodiment. A photo-detector 1110 and a shutter plate 1120 form in combination the hammer sensor 1100, and an assembling work and a repairing work are easy because of the wide space around the catcher 134.

Figure 14:
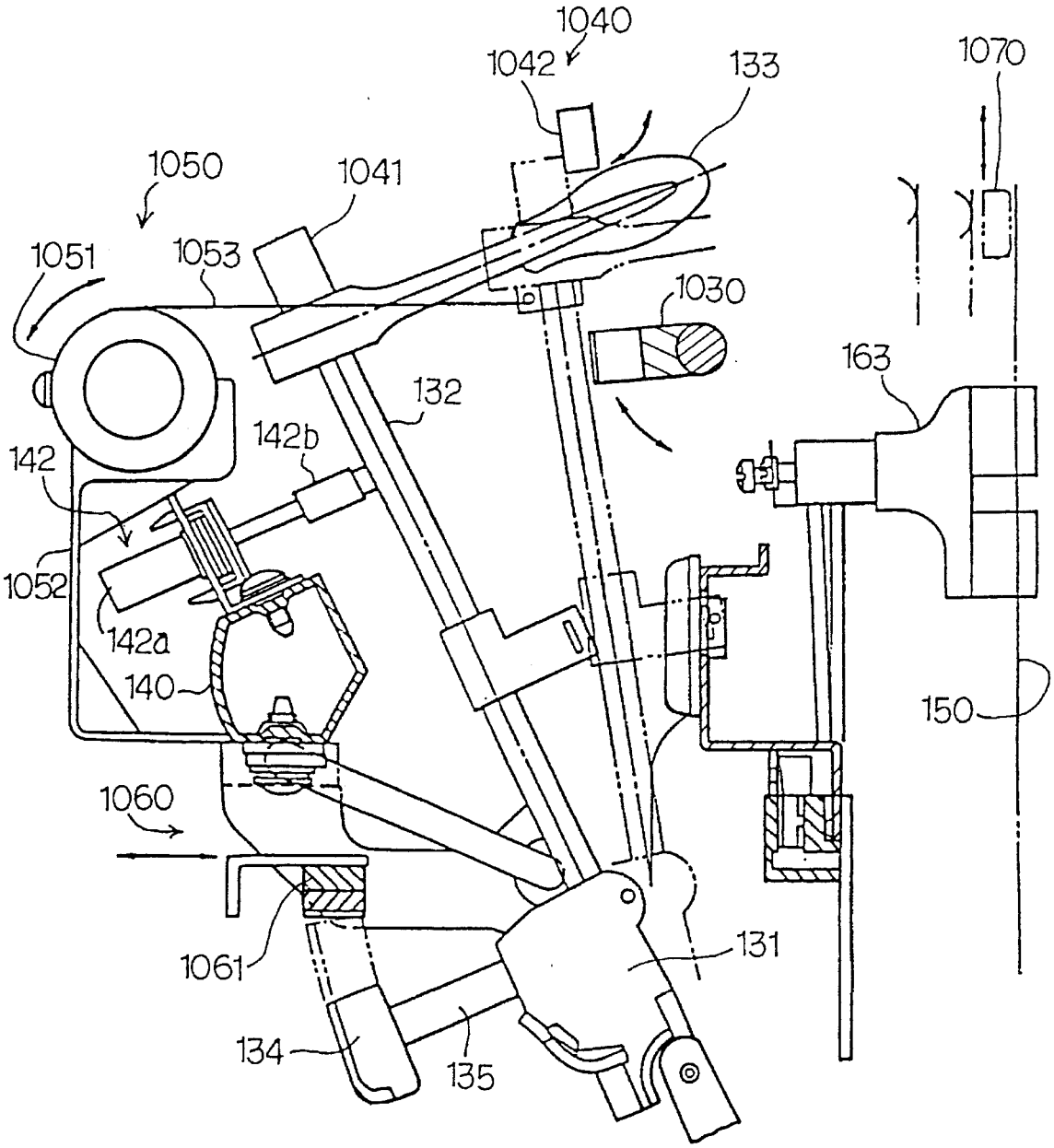
FIG. 14 is a composite view showing various modifications of the silent system available for the keyboard musical instrument.

FIG. 14 shows various silent systems available for the keyboard musical instrument according to the present invention, parts of the upright piano are labeled with the same references as those of the first embodiment.

Reference numeral 1030 designates one of the available silent systems, and the hammer shank 132 rebounds on the silent system 1030.

Another silent system 140 is formed by a projection 1041 attached to the hammer head 133 and a stopper 1042 movable into and out of the trajectory of the projection 1041.

Yet another silent system 1050 has a rotatable pulley 1051 rotatably supported by a bracket 1052 fixed to the hammer rail 140 and a flexible string 1053 connected between the hammer shank 132 and the rotatable pulley 1051. The pulley 1051 is rotated by a motor unit or a mechanical link.

Still another silent system 1060 is implemented by a slidable stopper 1061. The slidable stopper 1061 is moved into and out of the trajectory of the catcher 134, and the catcher 134 rebounds on the slidable stopper 1061.

A movable stopper 1070 may be vertically moved into and out of the trajectory of the hammer head 133. The hammer head 133 rebounds on the movable stopper 1070 in the blocking position BP.

Figure 15:
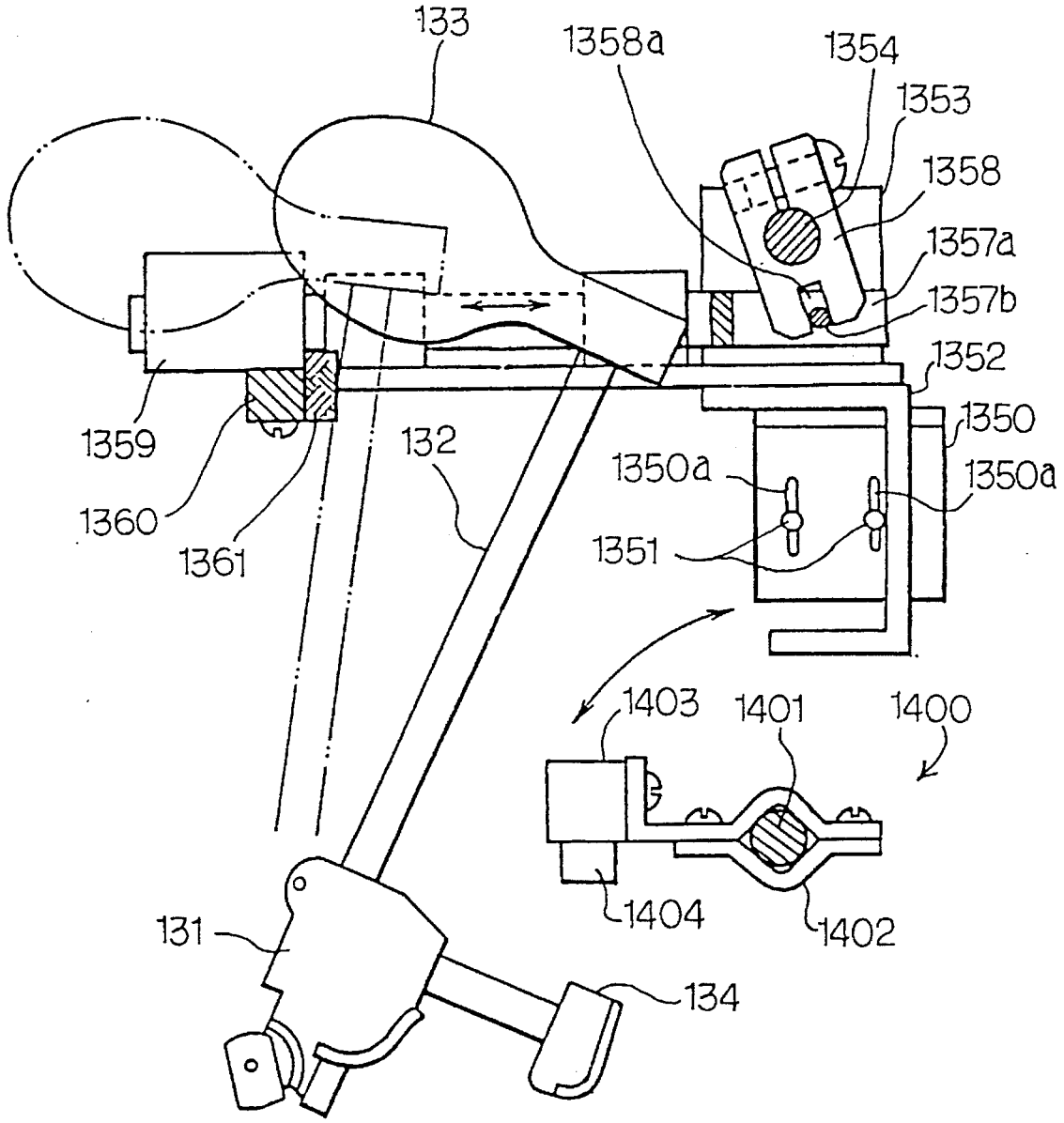
FIG. 15 is a composite view showing other modifications of the silent system.

A slidable hammer shank stopper 1300 or a rotatable catcher stopper 1400 is also available for the keyboard musical instrument using the upright piano 100. FIG. 15 illustrates the structure of the slidable shank stopper 1300 and the structure of the rotatable catcher stopper 1400, and FIG. 16 illustrates the layout of the slidable shank stopper 1300.

Figure 16:
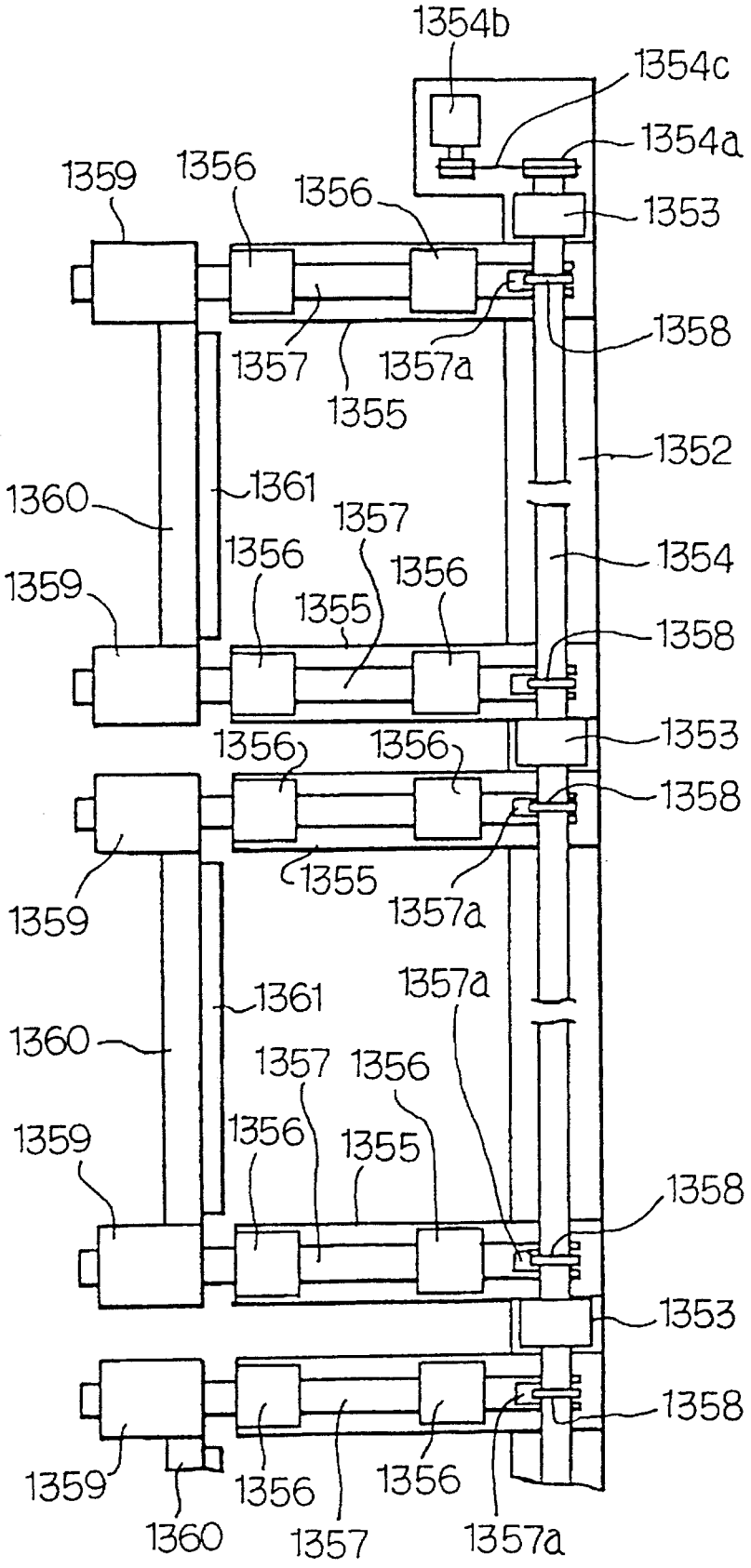
FIG. 16 is a plan view showing a slidable shank stopper shown in FIG. 15 as one of the modifications.

In FIGS. 15 and 16, reference numeral 1350 designates brackets attached to the action brackets of the upright piano. Elongated slits 1350*a* are formed in the bracket 1350, and screws 1351 vertically regulate the positions of the brackets 1350. A channel shaped bracket 1352 is connected to the brackets 1350, and bearing units 1353 are mounted on the channel shaped bracket 1352 at spacings. The bearing units 1353 rotatably support a shaft member 1354, and arms 1355 are further attached to the channel shaped bracket 1352. The arms 1355 project toward the hammers, and are placed in the space where a frame and action brackets are provided. On each of the arms 1355 are mounted two bearing units 1356 which slidably support a rod member 1357. The rod member 1357 has a bifurcated end portion 1357*a*, and a pin member 1357*b* is fixed to the bifurcated end portion 1357*a*. On the other hand, cam members 1358 are attached to the shaft member 1354, and are inserted into the bifurcated end portions 1357*a*. Each of the cam member 1358 has a bifurcated end portion, and the pin members 1357*b* are inserted into the bifurcated end portions of the cam members 1358, respectively. A pulley member 1354*a* is fixed to the shaft member 1354, and a motor unit 1354*b* rotates the pulley 1354*a* through a belt 1354*c*. When the shaft member 1354 is bidirectionally rotated, the cam members 1358 reciprocate the rod members 1357.

A block 1359 is attached to the other end of the rod member 1357, and a plate member 1360 extends between two adjacent blocks 1359. A stopper 1361 is attached to the plate member 1360, and the position of the stopper 1361 is changeable through the reciprocating motion of the rod member 1357.

FIG. 15 illustrates the stopper 1361 in the blocking position BP, and the hammer shank 132 rebounds on the stopper 1361 before an impact on the strings. On the other hand, if the cam members 1358 is rotated in the clockwise direction, the stoppers 1361 are moved leftwardly, and enter into the free position.

The rotatable catcher stopper 1400 comprises a rotatable shaft member 1401, supporting brackets 1402 attached to the rotatable shaft member 1401 and a rail member 1403 attached to the supporting brackets 1402 and cushion members 1404 attached to the rail member 1403. If the shaft member is rotated in the clockwise direction, the hammer head 133 can strike the strings without an interruption of the rotatable catcher stopper 1400. However, if the shaft member 1401 is rotated in the counter clockwise direction, the cushion members 1404 become closer to the catchers 134, and the catchers 134 rebound on the cushion members 1404 before the strike against the strings.

What is claimed is:

1. A keyboard musical instrument having at least an acoustic sound mode and an electronic sound mode, comprising:

a) an acoustic piano including a-1) a plurality of keys selectively depressed by a player in said acoustic sound mode and said electronic sound mode, a-2) a plurality of hammer assemblies respectively associated with said plurality of keys, and rotatably supported, a-3) a plurality of key action mechanisms functionally connected to said plurality of keys, respectively, and selectively driving said plurality of hammer assemblies for rotation, and a-4) a plurality of string means respectively associated with said plurality of keys, and selectively struck by said plurality of hammer assemblies in said acoustic sound mode for producing acoustic sounds;

b) a silent system changed between a free position in said acoustic mode and a blocking position in said electronic sound mode, said silent system in said free position allowing said plurality of hammer assemblies to selectively strike said plurality of string means, said silent system in said blocking position causing said hammer assemblies to rebound thereon before impacts on said plurality of string means; and c) an electronic system including c-1) a plurality of hammer sensors respectively monitoring said plurality of hammer assemblies, and respectively producing a plurality of hammer position signals indicative of trajectories of the associated hammer assemblies between respective home positions and respective rebounding points, impact timings being represented by intermediate points on said trajectories, respectively, said rebounding points being different between said acoustic sound mode and said electronic sound mode, c-2) a delay means delaying said impact timing so as to determine key-on timings, respectively, c-3) a first music data producing means for producing first music data respectively containing said key-on timings in said acoustic sound mode, c-3) a second music data producing means for producing second music data respectively containing said key-on timings in said electronic sound mode, and c-4) an electronic sound generating means responsive to said second music data for producing electronic sounds in said electronic sound mode.

2. The keyboard musical instrument as set forth in claim 1, in which said key-on timings are regulated to said rebounding points.

3. The keyboard musical instrument as set forth in claim 1, in which said first music data producing means and said second music data producing means further produce third music data containing key-off timings in said acoustic sound mode and fourth music data containing said key-off timings in said electronic sound mode, respectively, each of said key-off timings being indicative of one of a termination of sound and a decay of sound.

4. The keyboard musical instrument as set forth in claim 3, further comprising a memory means for storing at least one of said first and third music data and said second and fourth music data, and a playback means responsive to said one of said first and third music data and said second and fourth music data for selectively activating actuator units respectively associated with said plurality of keys, the activated actuator units moving said keys instead of said player for producing said acoustic sounds.

5. The keyboard musical instrument as set forth in claim 1, in which a delay introduced by said delay means is calculated by dividing a distance between said impact point and said rebounding point by a hammer velocity.

* * * * *